US005112709A

United States Patent [19]

Yamazaki et al.

[11] Patent Number: 5,112,709

[45] Date of Patent: May 12, 1992

[54] RED REPRODUCTION-IMPROVING ELECTROPHOTOGRAPHIC IMAGE-FORMING METHOD USING AN AMORPHOUS SILICON PHOTOSENSITIVE MEMBER HAVING A SURFACE LAYER COMPOSED OF A HYDROGENATED AMORPHOUS SILICON CARBIDE

[75] Inventors: Koji Yamazaki, Ebina; Shigenori Ueda; Toshiyuki Ehara, both of Yokohama, all of Japan

[73] Assignee: Canon Kabushiki Kaisha, Tokyo, Japan

[21] Appl. No.: 637,955

[22] Filed: Jan. 9, 1991

Related U.S. Application Data

[63] Continuation of Ser. No. 373,022, Jun. 29, 1989, abandoned.

[30] Foreign Application Priority Data

Jul. 1, 1988 [JP] Japan ..... 63-164204
Oct. 5, 1988 [JP] Japan ..... 63-249813

[51] Int. Cl.[5] ..... G03G 13/01; G03G 13/22

[52] U.S. Cl. ..... 430/46; 430/31; 430/65; 430/66; 430/67; 430/122; 430/125; 430/126; 355/211; 355/229

[58] Field of Search ..... 430/31, 46, 65, 66, 430/67, 125, 126, 122

[56] References Cited

U.S. PATENT DOCUMENTS 4,555,464 11/1985 Kido et al. ..... 430/67
4,675,265 6/1987 Kazama et al. ..... 430/66 X
4,681,826 7/1987 Fukatsu et al. ..... 430/67 X
4,687,722 8/1987 Ogawa ..... 430/67 X
4,777,103 10/1988 No et al. ..... 430/66
4,804,604 2/1989 Shirai et al. ..... 430/66 X
4,889,783 12/1989 Yamazaki ..... 430/67 X

FOREIGN PATENT DOCUMENTS 57-115551 7/1982 Japan ..... 430/67
62-189475 8/1987 Japan ..... 430/66

*Primary Examiner*—Roland Martin
*Attorney, Agent, or Firm*—Fitzpatrick, Cella, Harper & Scinto

[57] ABSTRACT

A red reproduction-improving electrophotographic image-forming method to be practiced in an electrophotographic image-forming system having a halogen lamp image-forming light source, characterized by using:

(a) an image-forming light of a continuous wavelength in the region of from 400 to 700 nm from said halogen lamp light source, (b) a magnet roller capable of forming toner brush comprising magnetic materials of said magnetic toner in said cleaning mechanism, and (c) an amorphous silicon system photosensitive member in a cylindrical form as said cylindrical photosensitive member: said amorphous silicon system photosensitive member comprising a substrate and a light receiving layer which comprises a 0.01 to 10 μm thick charge injection inhibition layer composed of an amorphous material containing silicon atoms as the matrix, a 1 to 100 μm thick photoconductive layer of 3.2 to 3.5 in refractive index composed of an amorphous material containing silicon atoms as the matrix and at least hydrogen atoms and a 4000 to 10000 Å thick surface layer of 1.9 to 2.3 in refractive index composed of A-SiC:H material.

7 Claims, 9 Drawing Sheets

RED REPRODUCTION-IMPROVING ELECTROPHOTOGRAPHIC IMAGE-FORMING METHOD USING AN AMORPHOUS SILICON PHOTOSENSITIVE MEMBER HAVING A SURFACE LAYER COMPOSED OF A HYDROGENATED AMORPHOUS SILICON CARBIDE

This application is a continuation of application Ser. No. 373,022 filed Jun. 29, 1989, now abandoned.

FIELD OF THE INVENTION

The present invention relates to a red reproduction-improving electrophotographic image-forming method using a specific amorphous silicon photosensitive member having a specific surface layer composed of a hydrogenated amorphous silicon carbide. More particularly, the present invention relates to an electrophotographic image-forming method aiming at improvement in red reproduction in a high-speed electrophotographic copying system or an electrophotographic color copying system having a plurality of development mechanisms wherein an amorphous silicon photosensitive member is used. The term "red reproduction" is a generally recognized standard expression to be used upon judgment on reproduced black and white copied images obtained from a black and red original containing, for example, black-colored characters and red-colored characters, such as vermilion inkpad seal of whether the reproduced images of said red-colored characters are appropriate as well as those of said black-colored characters.

BACKGROUND OF THE INVENTION

There have been provided a variety of amorphous silicon photosensitive members. And such amorphous silicon photosensitive members have been evaluated as being high in the surface hardness, exhibiting a high sensitivity against a long wavelength light such as a visible light (from 400 to 700 nm) and a semiconductor laser beam (from 770 nm to 800 nm) and its surface being maintained uniform even upon repeated use for a long period of time. In view of this, they have been desirably used as an electrophotographic photosensitive body, for example, in high-speed electrophotographic copying apparatus or laser beam printer.

The image-forming method in any of these cases is carried out, for example, in the way as shown in FIG. 3. FIG. 3 is a schematic explanatory view illustrating a typical embodiment for carrying out the image-forming method in the conventional electrophotographic copying apparatus. As shown in FIG. 3, near a cylindrical photo-sensitive member 301 to be maintained at a temperature of 42° to 45° C. which rotates in the arrow direction, there are provided a main corona charger 302, an electrostatic latent image-forming mechanism 303, a development mechanism 304, a transfer sheet feeding mechanism 305, a transfer charger 306(*a*), a separating charger 306(*b*), a cleaning mechanism 307, a transfer sheet conveying mechanism 308 and a charge-removing lamp 309.

The cylindrical photosensitive member 301 is uniformly charged by the corona charger 302 to which a high voltage of, for example, +6 to +8 KV is impressed. Then, an original 312 to be copied is irradiated with a light from a light source 310 such as a halogen lamp of 50 to 80 V and 200 to 400 W through a contact glass plate 311 and the resulting light as reflected is projected through mirrors 313, 314 and 315, a lens system 317 containing a filter 318 and a mirror 316 onto the surface of the photosensitive member 301 to form an electrostatic latent image corresponding to the original 312. This electrostatic image is developed with negative toner supplied by the development mechanism 304 to provide a toner image. A transfer sheet P is supplied through the transfer sheet feeding mechanism 305 comprising a transfer sheet guide 319 and a pair of feed timing rollers 322 so that the transfer sheet P is brought into contact with the surface of the cylindrical photosensitive member 301, and corona charging is effected with the positive polarity different to that of the toner from the rear of the transfer sheet P by the transfer charger 306(*a*) to which a high voltage of +7 to +8 KV is applied in order to transfer the negative toner image onto the transfer sheet P. The transfer sheet P having the toner image transferred thereon is electrostatically removed from the cylindrical photosensitive member 301 by the charge-removing action of the separating corona charger 306(*b*) where a high AC voltage of 12 to 14 $KV_{p-p}$ is impressed with 300 to 600 Hz and is then conveyed by the transfer sheet conveying mechanism 308 to a fixing zone (not shown).

The residual toner on the surface of the cylindrical photosensitive member 301 is removed by a cleaning blade 321 when arrived at the cleaning mechanism 307 and the removed toner is discharged by way of a waste toner-discharging means (not shown). Thereafter, the thus cleaned cylindrical photosensitive member 301 is entirely exposed to light by the charge-removing lamp 309 to erase the residual charge and is recycled.

The amorphous silicon photosensitive member to be used in the above image-forming method has such advantages as above mentioned, that is, it has a high sensitivity also against not only a visible light (from 400 to 700 nm) but also a long wavelength light (sensitivity peak near 680 nm and sensitivity region of 400 to 800 nm), but in turn, has a disadvantage that, there sometimes occurs a problem that reproduction of, for example, a red colored seal in a original is not sufficient when it is used in the image-forming method in an analog electrophotographic copying apparatus having a halogen lamp as the image-forming light source mainly because of defects in the matching of the light source and the photosensitive member. In order to eliminate this disadvantage and to ensure the red reproduction, there has been proposed use of a long wave length light (IR) cutoff filter such as soda glass.

However, there is a problem in this case that the total quantity of light from the light source to be irradiated for the formation of an electrostatic latent image will be somewhat reduced because of using such cutoff filter and in order to supplement the deficient quantity of light, it is necessitated to heighten the wattage of the light source. This situation is apparent particularly in the case of a high-speed electrophotographic copying apparatus in which the image-making process is quickly carried out and the period of image exposure is much shorter in comparison with the case of a normal-speed electrophotographic copying apparatus.

By the way, in the recent office automation market, there is a increased demand for provision of a high-speed electrophotographic copying apparatus of low electricity consumption for which a power source of 100 V and 15 A can be used in view of remarkable increase in the amount of papers to be copied, reduction of expenses for the copying, etc.

On the other hand, there is a problem for attaining the above demand that electric power is remarkably consumed for the main driving motor, light source, fixing heater, sorter, etc. in the high speed copying system.

Now, as for the amorphous silicon photosensitive member, it is evaluated as being the most suitable for use in a super-high speed heavy duty copying apparatus because of excellence in stability and abrasion resistance in addition to the foregoing advantages.

However, it is extremely difficult to raise the electric power to be applied so as to increase the quantity of light to be irradiated in order to ensure the red reproduction in the high speed electrophotographic copying apparatus in which such amorphous silicon photosensitive member being installed, because of the foregoing demand for low electricity consumption and an increase in additional electric power distribution for attached equipments.

Therefore, the maximum copying speed for the high speed electrophotographic copying apparatus under which acceptable reproduction of a red-colored seal in an original is ensured is of the level of 440 mm/sec. for the image-forming process speed (in other words, 70 copies per minute for a A-4 size original. And in the case where it is intended to provide such an electrophotographic copying apparatus which is of the copying speed exceeding the above level, the matter of the red reproduction is to be somewhat sacrificed regardless of dissatisfactions of users.

Independently from what above mentioned, in recent years, there has been a demand from users for electrophotographic copying apparatus to be able to reproduce multicolored images comprising red, blue, etc. other than black. In such copying apparatus, a plurality of development mechanisms are provided with a photosensitive member so as to make multicolored images.

However, in the case of using an amorphous silicon photosensitive member in such color-copying apparatus, there sometimes occur charge decay in dark. In order to avoid this problem, it is necessary to make both the charge and the exposure for forming an electrostatic latent image remarkably large for the development mechanism positioned apart from the corona charger in comparison with those for the development mechanism positioned near the corona charge.

On the other hand, the electrophotographic copying apparatus is used with an electric power source of 100 V and 15 A and because of this, there is a limit for the total electric power. In view of this, for an electrophotographic copying apparatus capable of making multicolored images in which an amorphous silicon photosensitive member is used, it is extremely difficult to ensure the red reproduction.

SUMMARY OF THE INVENTION

The present invention is aimed at solving the foregoing problems in the aforementioned known image-forming method and developing an improved image-forming process which makes it possible to desirably attain desirable red reproduction of a red colored original at high speed by using an amorphous silicon photosensitive member and which meets the above-mentioned demands.

An object of the present invention is to provide an improved high-speed image-forming method with low electricity consumption which repeatedly provides a high quality copied image.

Another object of the present invention is to provide an improved image-forming method capable of repeatedly providing a high quality multicolored copied image even in a multicolored image-forming apparatus with low electricity consumption in which a plurality of development mechanisms being installed.

A further object of the present invention is to provide an improved image-forming method capable of providing a high quality copied image excelling in reproduction of a red-colored seal of an original without raise of the electric power to be applied.

According to one aspect of the present invention, there is provided an improved image-forming method to be practiced in an electrophotographic copying apparatus capable of properly adjusting an image-forming process speed, characterized by using a light of a continuous wavelength in the region of from 400 nm to 700 nm from a halogen lamp light source; a magnet roller as the cleaning means for a photosensitive member: and said photosensitive member comprising an amorphous silicon photosensitive member comprising a substrate and a light receiving layer which comprises a 0.01 to 10 μm thick charge injection inhibition layer composed of an amorphous material containing silicon atoms as the matrix (hereinafter referred to as "A-Si"), a 1 to 100 μm thick photoconductive layer of 3.2 to 3.5 in refractive index composed of an amorphous material containing silicon atoms as the matrix and at least hydrogen atoms (hereinafter referred to as "A-Si:H") and a 4000 to 10000 Å(0.4 to 1 μm) thick surface layer of 1.9 to 2.3 in refractive index composed of an amorphous material containing silicon atoms, carbon atoms and hydrogen atoms (hereinafter referred to as "A-SiC:H"): said A-SiC:H material to constitute said surface layer is a member selected from the group consisting of A-SiC:H materials belonging to one of the following five ranges (i) to (v): (i) range of $D_1$–$D_2$, (ii) range of $D_3$–$D_4$, (iii) range of $D_5$–$D_6$, (iv) range of $D_7$–$D_8$ and (v) range of $D_9$–$D_{10}$, where the value of each D is obtained by the following equation (I) relating to the refractive index-depending linear line of a critical red reproduction thickness of the surface layer:

$$D_K = A_K X n + B_K \quad (I)$$

where $4000 \leqq D_K \leqq 10000$, K is an intercept of 1 to 10, $A_K = -a_K \times 0.462 - 60$ ($A_K$ is an inclination of said linear line), $B_K = 1.924 \times a_K + 120$ ($B_K$ is an integer of $D_K$), and

| | |
|---|---|
| $a_1 = 4300$ | $a_2 = 5100$ |
| $a_3 = 5700$ | $a_4 = 6500$ |
| $a_5 = 7200$ | $a_6 = 8000$ |
| $a_7 = 8600$ | $a_8 = 9400$ |
| $a_9 = 10000$ | $a_{10} = 10800$ |

According to another aspect of the present invention, there is provided an improved image-forming method in which an image-forming process speed is adjusted to 450 mm/sec. or more in the foregoing electrophotographic image-forming method.

The foregoing specific amorphous silicon photosensitive member to be used in the image-forming method of the present invention is hardly worn with its surface layer even upon repeated use for a long period of time and functions to cut off a long wavelength light (IR), and because of this, it makes possible to repeatedly obtain a desirably reproduced image of a red-colored mark or character in an original without raise of electric power to be applied, without occurrence of smeared image and without appearance of any undesirable ghost.

DETAILED DESCRIPTION OF THE INVENTION

Figure 1:
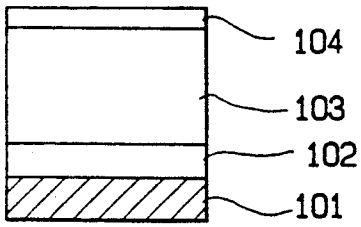
FIG. 1 is a schematic view illustrating the typical layer constitution of a representative amorphous silicon photosensitive member to be used in the present invention.

The amorphous silicon photosensitive member to be used in the image-forming method according to the present invention is in a cylindrical form and is typically of the constitution as shown in FIG. 1, in which are shown an electrically conductive substrate 101 which comprises aluminum, etc. and a light receiving layer comprising a 0.01 to 10 μm thick charge injection inhibition layer 102, a 1 to 100 μm thick photoconductive layer 103 having a refractive index of 3.2 to 3.5 and a 4000 to 10000 Å thick surface layer 104 having a refractive index of 1.9 to 2.3. The charge injection inhibition layer 102 serves to prevent charges from injecting into the photoconductive layer 103 from the side of the substrate 101. The photoconductive layer 103 serves to generate electrons and holes upon light irradiation and convert image information into electric potential information. The surface layer 104 serves to protect the photoconductive layer 103 from being worn away because of abrasions by developer (toner), transfer sheet, cleaning means, etc. and it also serves to permit the reflected light to desirably impinge into the photoconductive layer 103 while preventing charges from injecting into the photoconductive layer 103 from the side of the surface thereof.

Any of the charge injection inhibition layer 102 and the photoconductive layer 103 is composed of a A-Si material, if necessary, containing one or more kinds of atoms capable of compensating dangling bonds of the silicon atoms such as hydrogen atoms or halogen atoms (this material being hereinafter referred to as "A-Si(H,X)"), valence electron controlling atoms such as group III or V atoms of the Periodic Table, one or more kinds of modifying atoms selected from the group consisting of oxygen atoms, carbon atoms and nitrogen atoms.

The surface layer 104 is composed of a specific amorphous material containing silicon atoms (Si), carbon atoms (C) and hydrogen atoms (H) which satisfies the foregoing condition based on the foregoing equation (I).

The surface layer 104 may contain, in addition to the three kinds of atoms, halogen atoms, group III atoms or group V atoms of the Periodic Table, or one or more kinds of atoms selected from the group consisting of oxygen atoms and nitrogen atoms.

Each of the layers to constitute the light receiving layer of the photosensitive member to be used in the image-forming method according to the present invention may be properly prepared by vacuum deposition method utilizing the discharge phenomena such as RF or microwave glow discharging methods wherein relevant film-forming raw material gases are selectively used.

Specifically, the photosensitive member to be used in the image-forming method according to the present invention may be prepared, for example, in such manner as disclosed in the specification of U.S. Pat. No. 4,738,913, wherein appropriate film-forming raw material gases are used and film-forming conditions such as flow rates of the selected film-forming raw material gases, substrate temperature, pressure in the film-forming reaction zone, discharging power to be applied, etc. are properly selected upon the kind of a layer to be formed.

Figure 2A:
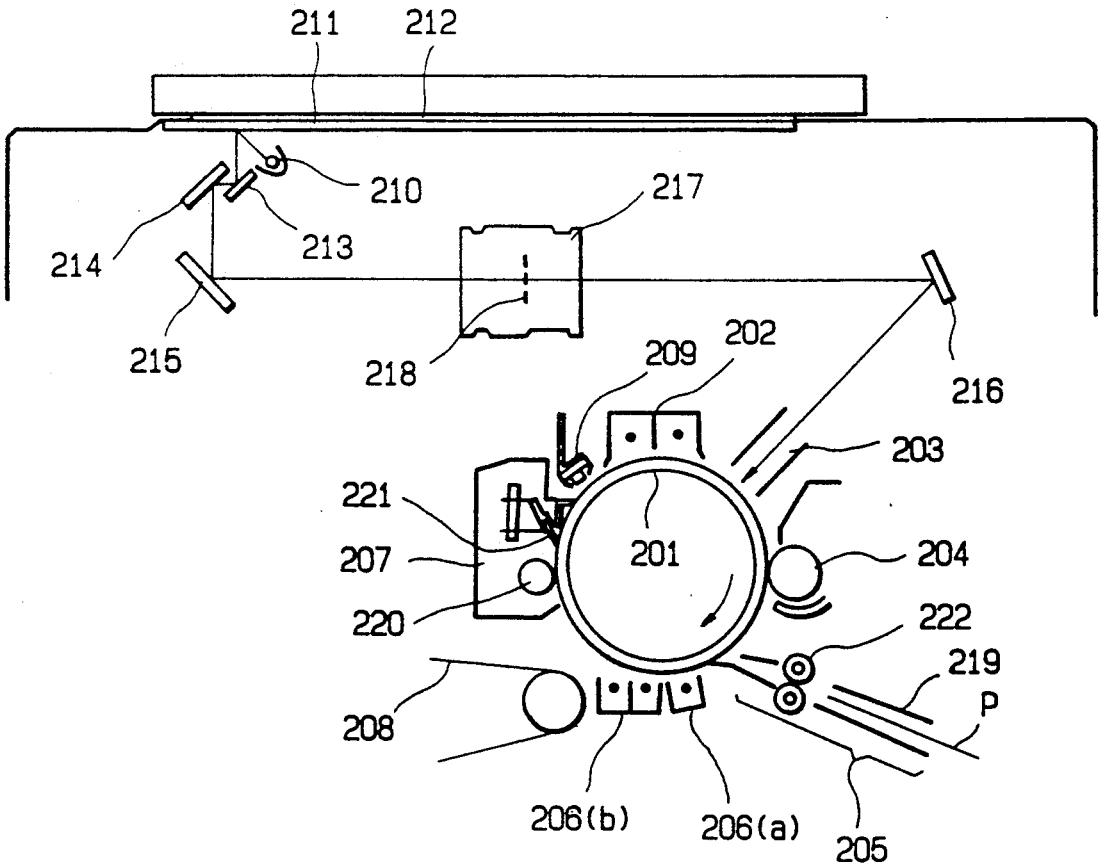
FIG. 2(A) and FIG. 2(B) are schematic explanatory views respectively illustrating the constitution of an electrophotographic copying apparatus which is suited for practicing the image-forming method according to the present invention.
Figure 2B:
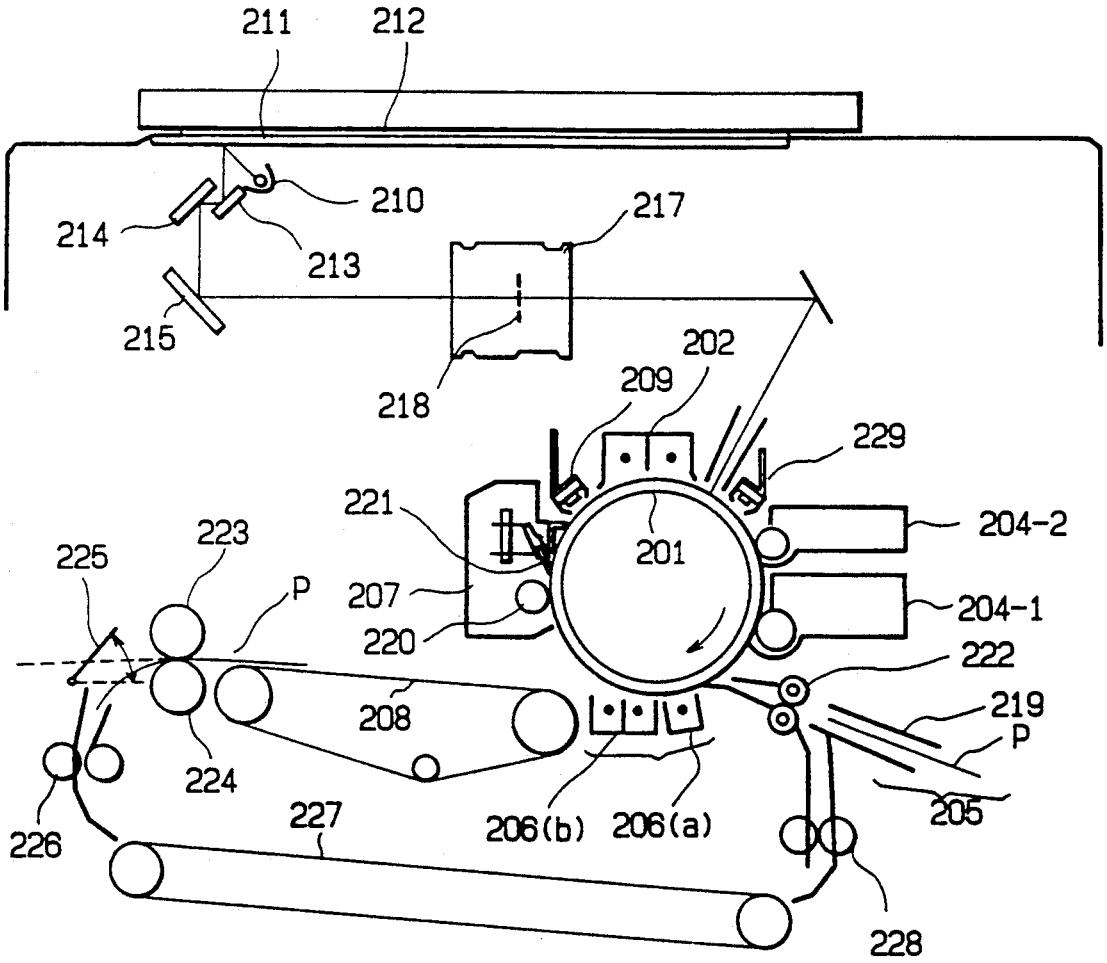

The image-forming method using the foregoing specific photosensitive member may be effectively carried out in an appropriate electrophotographic copying apparatus having such constitution as shown in FIG. 2(A) or FIG. 2(B). The apparatus shown in FIG. 2(A) is used for reproducing a white-and-black image (monocolor image), and the apparatus shown in FIG. 2(B) is used for reproducing a multicolored image.

Figure 3:
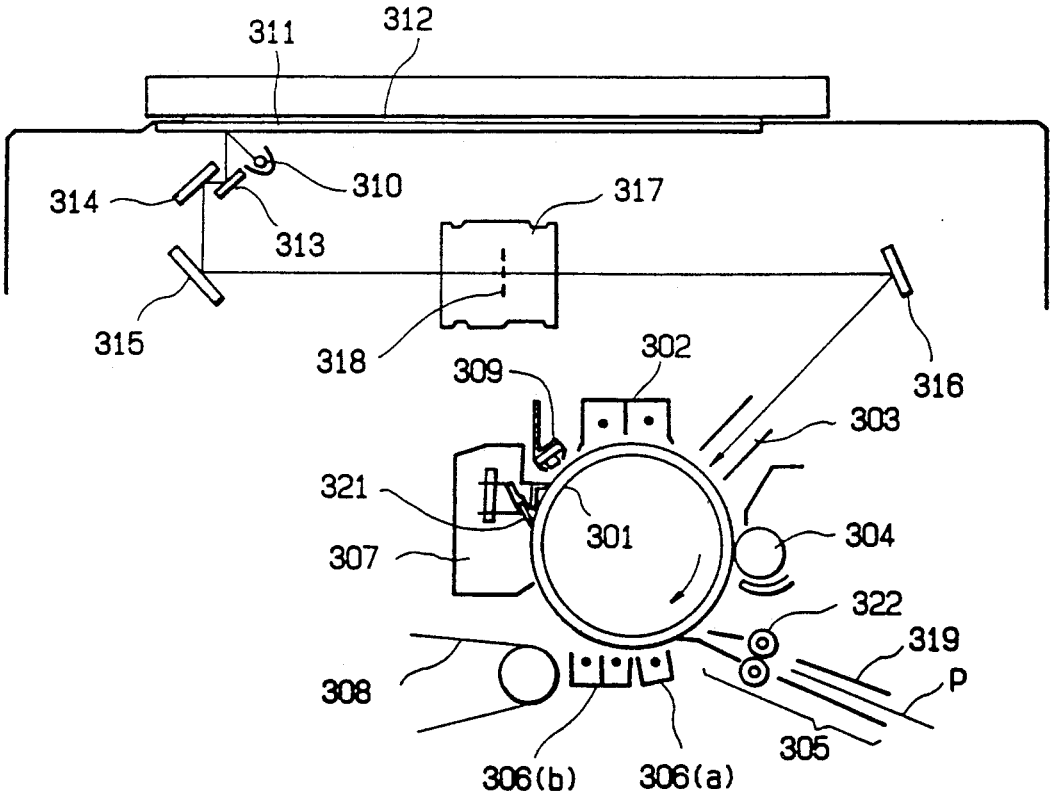
FIG. 3 is a schematic explanatory view illustrating the conventional electrophotographic copying apparatus.

The constitution of the electrophotographic copying apparatus shown in FIG. 2(A) is the same as the electrophotographic copying apparatus shown in FIG. 3.

In FIG. 2(A), there are shown the foregoing specific amorphous silicon photosensitive member 201 in a cylindrical form which has the layer constitution as shown in FIG. 1, a main corona charger 202, an electrostatic latent image-forming mechanism 203, a development mechanism 204, a transfer sheet feeding mechanism 205 comprising a transfer sheet guide 219 and a pair of feed timing rollers 222, a transfer charger 206(*a*) and a separating corona charger 206(*b*). Numeral reference 207 stands for a cleaning mechanism comprising a magnet roller 220, a cleaning blade 221 and a waste toner-discharging means (not shown). Numeral reference 209 stands for a charge removing lamp. Numeral reference 212 stands for an original placed on a contact glass plate 211. Numeral reference 210 stands for a halogen lamp light source. Numeral references 213, 214, 215 and 216 stand for respectively a mirror and numeral reference 217 stands for a lens system containing a long wavelength light cutoff filter.

The electrophotographic copying apparatus shown in FIG. 2(B) is of the same constitution as the electrophotographic copying apparatus shown in FIG. 2(A), except the former apparatus has a light source 229 for blank exposure which serves to remove an electrostatic latent image which is to be eliminated from being developed, a plurality of development mechanisms i.e. a first development mechanism 204-1 and a second development mechanism 204-2 and a transfer sheet-recycling mechanism for providing a multicolored image. That is, the transfer sheet-recycling mechanism of the electrophotographic copying apparatus shown in FIG. 2(B) comprises a transfer sheet-conveying system 208, a pair of fixing rollers 223, 224, a direction-altering plate 225, a pair of feed rollers 226, a conveying system 227 and a pair of feed rollers 228.

Any of these two electrophotographic copying apparatuses shown in FIG. 2(A) and FIG. 2(B) is so designed that the cylindrical photosensitive member 201 can be rotated at a process speed of 450 mm/sec. or more.

In addition, any of the two copying apparatus is so designed that an original 212 to be copied is irradiated with a light from the halogen lamp light source 210 through the contact glass plate 211, the reflected light of a continuous wavelength in the range of from 400 to 700 nm is projected onto the surface of the cylindrical photosensitive member 201 through the mirrors 213, 214 and 215, the lens system 217 and the mirror 216, to thereby form an electrostatic latent image corresponding to the original.

As the magnet roller 220 to be employed in the image-forming method according to the present invention, there can be used any of the known magnet rollers such as one disclosed in the specification of U.S. Pat. No. 4,426,151 as long as it attains the object of the present invention. In the image-forming method according to the present invention, the magnet roller 220 serves to catch the residual magnetic toner on the surface of the cylindrical photosensitive member 201 and to form a toner brush thereon. The toner brush thus formed functions to gently polish the surface of the cylindrical photosensitive member 201 without the surface layer thereof being worn, whereby not only the residual magnetic toner but also other materials such as ozone-reacted products causing smeared image on an image to be obtained are effectively removed.

The materials still left unremoved on the surface of the cylindrical photosensitive member 201 by the toner brush are effectively removed in the successive cleaning operation by the cleaning blade 221.

The magnet roller 220 is so installed that there is left a space of 0.5 to 1 mm between its surface and the surface of the cylindrical photosensitive member 201 in which said toner brush is formed as desired.

The image-forming method of providing a black and white image according to the present invention using the electrophotographic copying apparatus shown in FIG. 2(A) is carried out, for example, in the following way.

That is, firstly, the cylindrical photosensitive member 201 is rotated at a rotational speed corresponding to a process speed of 450 mm/sec. or more, and is uniformly charged by the main corona charger 202 to which a voltage of +6 to +8 KV is applied. Then, an original 212 to be copied is irradiated with a light from the light source 210 comprising a halogen lamp of 50 to 80 V and 150 to 300 W through the contact glass plate 211. The resulting reflected light is adjusted through the mirrors 213, 214 and 215, the lens system 217 containing the cutoff filter 218 and the mirror 216 to be of 500 to 700 nm in wavelength, which is projected onto the surface of the cylindrical photosensitive member 201 to thereby form an electrostatic latent image corresponding to the original 212.

This electrostatic image is developed with negative magnetic toner supplied by the development mechanism 204 to provide a toner image. A transfer sheet P is fed through the transfer sheet feeding mechanism 205 comprising a transfer sheet guide 219 and a pair of feed timing rollers 222 so that the transfer sheet P is brought into contact with the surface of the cylindrical photosensitive member 201, and corona charging is effected with the positive polarity different to that of the magnetic toner from the rear of the transfer sheet P by the transfer charger 206(*a*) to which a voltage of +7 to +8 KV is applied in order to transfer the negative toner image onto the transfer sheet P. The transfer sheet P having the toner image transferred thereon is electrostatically removed from the cylindrical photosensitive member 201 by the charge-removing action of the separating corona charger 206(*b*) where a high AC voltage of 12 to 14 $KV_{p-p}$ is impressed with 300 to 600 Hz, then conveyed by the transfer sheet conveying mechanism 208 to a fixing zone (not shown) and taken out from the system. The cylindrical photosensitive member 201 arrives at the cleaning mechanism 207 where magnetic particles such as powdery magnetite, powdery iron, etc. contained in the residual toner left on the surface of the cylindrical photosensitive member 201 are firstly removed by the action of the toner brush formed on the magnetic roller 220, then the cylindrical photosensitive member 201 is polished by the cleaning blade 221 to thereby remove other remaining materials on the surface thereof without the surface layer of the cylindrical photosensitive member being worn.

The thus removed magnetic materials and other materials are discharged by way of a discharging means (not shown).

Thereafter, the cylindrical photosensitive member 201 thus cleaned with its surface is entirely exposed to light by the charge-removing lamp 209 to erase the residual charge and is recycled.

The image-forming method of providing a multicolored image according to the present invention using the electrophotographic copying apparatus shown in FIG. 2(B) is carried out, for example, in the following way.

That is, as well as in the above case, the cylindrical photosensitive member 201 is rotated at a rotational speed corresponding to an appropriate process speed for obtaining a multicolored image corresponding an original containing, for example, black-colored characters and red-colored characters such as vermilion inkpad seal, and is uniformly charged by the main corona charger 202 to which a voltage of +6 to +8 KV is applied. Then, an original 212 containing, for example, black-colored characters and red-colored characters such as vermilion inkpad seal to be copied is irradiated with a light from the light source 210 comprising a halogen lamp of 50 to 80 V and 150 to 350 W through the contact glass plate 211. The resulting reflected light is adjusted through the mirrors 213, 214 and 215, the lens system 217 containing the cutoff filter 218 and the mirror 216 to be of 500 to 700 nm in wavelength, which is projected onto the surface of the cylindrical photosensitive member 201 to thereby form an electrostatic latent image corresponding to the original 212. Then, the blank exposure source 229 is switched on upon receipt of a demanded signal of the color coding region by a digitizer (not shown) to extinguish a not wanted part of the electrostatic image for the 1st development. The remaining electrostatic image is developed with negative magnetic black toner supplied by the first development mechanism 204-1 to provide a toner image. A transfer sheet P is fed through the transfer sheet feeding mechanism 205 comprising the transfer sheet guide 219 and the feed timing rollers 222 so that the transfer sheet P is brought into contact with the surface of the cylindrical photosensitive member 201, and corona charging is effected with the positive polarity different to that of the magnetic toner from the rear of the transfer sheet P by the transfer charger 206(*a*) to which a voltage of +7 to +8 KV is applied in order to transfer the negative toner image onto the transfer sheet P. The transfer sheet P having the toner image transferred thereon is electrostatically removed from the cylindrical photosensitive member 201 by the charge-removing action of the separating corona charger 206(*b*) where a high AC voltage of 12 to 14 $KV_{p-p}$ is impressed with 300 to 600 Hz, then conveyed by the transfer sheet conveying mechanism 208 to the fixing rollers 223, 224 where the toner image on the transfer sheet P is fixed. The transfer sheet P having the fixed toner image thereon is then passed downward by the direction-altering plate 225 and conveyed through the feed rollers 226, the conveying system 227 and the feed rollers 228 to the transfer sheet feeding mechanism 205. During this period, the cylindrical photosensitive member 201 arrives at the cleaning mechanism 207 where the residual toner left on the surface thereof is removed by the action of the toner brush formed on the magnet roller 220 and by the cleaning blade 221 in the same way as in the foregoing case. Thereafter, the cylindrical photosensitive member 201 thus cleaned with its surface is entirely exposed to light by the charge-removing lamp 209 to erase the residual charge and is recycled to the second image-forming process. In the second image-forming process, an electrostatic latent image is formed on other part than the part where the previous electrostatic image was formed on the surface of the cylindrical photosensitive member 201 and a second toner image is formed with negative magnetic red toner supplied by the second development 204-2 in the same manner as the previous image-forming process. Then, transfer sheet P having the previously fixed color image thereon is fed through the transfer sheet feeding mechanism 205 comprising the transfer sheet guide 219 and the feed timing rollers 222 so that the transfer sheet P is brought into contact with the surface of the cylindrical photosensitive member 201, and corona charging is effected with the positive polarity different to that of the magnetic toner from the rear of the transfer sheet P by the transfer charger 206(*a*) to which a voltage of +7 to +8 KV is applied in order to transfer the negative toner image onto the transfer sheet P. The transfer sheet P having the second color toner image transferred thereon is electrostatically removed from the cylindrical photosensitive member 201 by the charge-removing action of the separating corona charger 206(*b*) where a high AC voltage of 12 to 14 $KV_{p-p}$ is impressed with 300 to 600 Hz, then conveyed by the transfer sheet conveying mechanism 208 to the fixing rollers 223, 224 where the second color toner image is fixed. The transfer sheet having the fixed first and second toner images thereon is taken out from the system. On the other hand, the cylindrical photosensitive member 201 arrives at the cleaning mechanism 207 where the residual toner on the surface thereof is removed by the action of the toner brush formed on the magnet rollers 220 and by the cleaning blade. The cylindrical photosensitive member 201 thus cleaned with its surface is entirely exposed to light by the charge-removing lamp 201 to erase the residual charge and is recycled.

In any of the above two cases, the specific surface layer composed of the foregoing specific A-SiC:H material of the cylindrical photosensitive member desirably functions as a long wavelength cutoff filter against an image-forming light and this makes it possible to provide a practically acceptable good red reproduction for a copied image.

In addition, in any of the two cases, because of using the magnet roller to remove magnetic materials contained in the residual magnetic toner left on the cylindrical photosensitive member with a toner brush comprising said magnetic materials formed thereon prior to the cleaning by the cleaning blade, the cylindrical photosensitive member is maintained without the said surface layer being worn even upon repeated use for a ling period of time and because of this, the foregoing function of the said surface layer to cut off a long wavelength light for the image-forming light is always secured and there is provided a desired copied image excellent in red reproduction even upon repeating the image-forming process for a long period of time without raising the electric power.

In fact, there is obtained a desired copied black and white image excellent in reproduction of the red characters as well as excellent in reproduction of the black color characters which corresponds the original in the former case. And, in the latter case, there is obtained a desired copied multicolored image excellent in reproduction of the red characters as well as excellent in reproduction of the black color characters which corresponds the original.

The present invention has been accomplished based on the findings obtained through the following experiments by the present inventors.

EXPERIMENT 1

There were provided a plurality of cylindrical photosensitive member samples, each of which being distinguished with the thickness of the surface layer.

That is, each of said plurality of cylindrical photosensitive member samples comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing specific A-SiC:H material which has a refractive index of 1.9 and a layer thickness in the range of 6000 to 11000 Å being laminated in this order on the surface of said aluminum cylinder.

Each of the cylindrical photosensitive member samples thus provided was evaluated with respect to residual potential using the electrophotographic copying apparatus shown in FIG. 2(A) in the following manner.

Firstly, the cylindrical photosensitive member was rotated and maintained at an image-forming process speed of 560 mm/sec. The cylindrical photosensitive member was uniformly charged by the main corona charger 202 to which a high voltage of +6 to +8 KV being applied. Then, the foregoing image-forming process was carried out, wherein the dark surface potential of the cylindrical photosensitive member was measured by a conventional electrostatic voltmeter Model 244 (product of Monroe Electronics, Inc.) placed at the development mechanism 204 to obtain a value of 400 V. Thereafter, the main corona charger 202 was switched off, and the successive image-forming process was carried out, wherein the surface potential of the cylindrical photosensitive member was measured in the same manner as in the previous case to thereby evaluate the residual potential of the cylindrical photosensitive member.

Figure 4A:
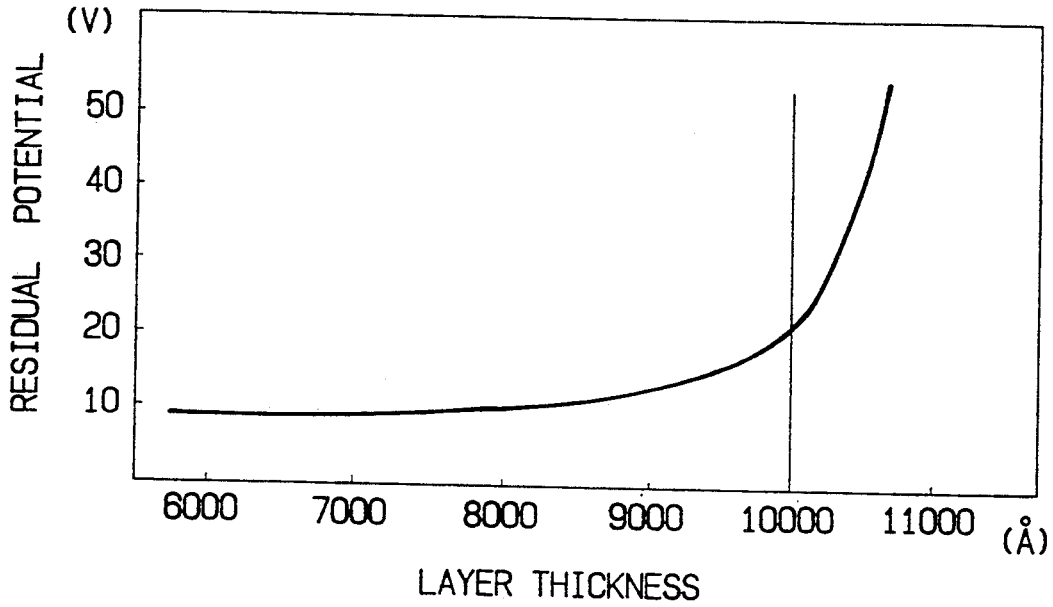
FIG. 4(A) and FIG. 4(B) are graphs respectively showing the examined results on the interrelation between the layer thickness and residual potential for the surface layer of an amorphous silicon photosensitive memeber in the later described Experiments.

The results obtained were as shown in FIG. 4(A).

From the results shown in FIG. 4(A), it has been found that the residual potential shows a tendency of relatively increasing when the layer thickness of the A-SiC:H surface layer exceeds 10000 Å and because of this, such cylindrical photosensitive member is not suited for effectively attaining the object of the present invention.

EXPERIMENT 2

There were provided a plurality of cylindrical photosensitive member samples, each of which being distinguished with the refractive index and the thickness of the surface layer.

That is, each of said plurality of cylindrical photosensitive member samples comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing A-SiC:H material which has a refractive index in the range of 1.8 to 2.3 and a layer thickness in the range of 6000 to 10000 Å being laminated in this order on the surface of said aluminum cylinder.

Each of the cylindrical photosensitive member samples thus provided was evaluated with respect to occurrence of uneven image density caused by uneven sensitivity on a copied image using the electrophotographic copying apparatus shown in FIG. 2(A) wherein as the cleaning roller 220, a magnet roller or an elastic gum roller was used.

In the evaluation, using a whole half tone original, the electrophotographic copying process was carried out intermittently for a A-4 size transfer sheet while making a predetermined interval after every electrophotographic image-forming process, and after 500,000 copies being made, there was observed occurrence of uneven image density caused by uneven sensitivity of the cylindrical photosensitive member on a copied image.

The results obtained were as shown in Table 1.

From the results shown in Table 1, it has been found that there is obtained a desirable result to effectively attain the object of the present invention when a magnet roller as the cleaning means and a cylindrical photosensitive member having a 4000 Å or more thick surface layer composed of the foregoing A-SiC:H material, the refractive index of which being in the range of 1.8 to 2.3, are used in combination.

In addition, any occurrence of smeared image was not observed in any case. Further, with respect to the thickness of the surface layer for each of the cylindrical photosensitive members after 100,000 copies being continuously made, there was observed a 300 to 1000 Å abrasion in the case of using the elastic gum roller but a distinguishable abrasion was not observed in the case of using the magnet roller.

In conclusion from the results obtained in Experiments 1 and 2, it has been recognized that a desirable result to effectively attain the object of the present invention is obtained when a cylindrical photosensitive member having a 4000 to 10000 Å thick surface layer composed of the foregoing A-SiC:H material, the refractive index of which being in the range of 1.8 to 2.3 and a magnet roller are used in combination in the electrophotographic image-forming process.

EXPERIMENT 3

In this experiment, the cylindrical photosensitive member to be used in the electrophotographic image-forming process according to the present invention was evaluated in the view points of red reproduction and appearance of a ghost for an image obtained and a lighting electric power for the halogen lamp light source 210 for obtaining a pertinent red reproduction.

There was provided a cylindrical photosensitive member sample which comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing A-SiC:H material which has a refractive index of 1.9 and a layer thickness of 5000 Å being laminated in this order on the surface of said aluminum cylinder.

The cylindrical photosensitive member thus provided was set to the electrophotographic copying apparatus shown in FIG. 2(A) and it was irradiated with a light from the halogen lamp light source 210 being adjusted with its wavelength to be in the region of 400 to 600 nm or in the region of 400 to 700 nm using one or more additional long wavelength light cutoff filters in addition to the filter 218 or with a light from the halogen lamp light source 210 being adjusted to be in the region of 400 to 800 without using such additional filter in the electrophotographic image-forming process in order to evaluate the situation of red reproduction on an image obtained.

In each case, at the time of irradiating the cylindrical photosensitive member with the above light, a lighting power for the halogen lamp was properly adjusted so as to obtain an appropriate image.

Figure 5:
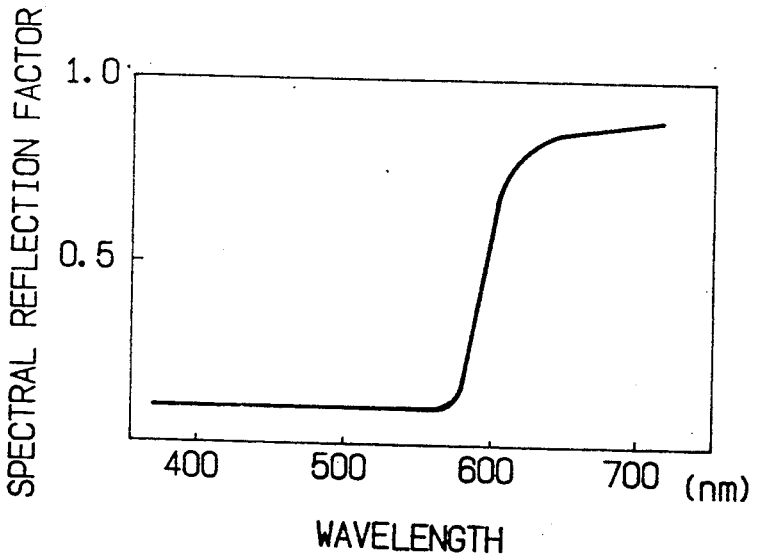
FIG. 5 is a graph showing the spectral reflection factor of the vermilion inkpad seal (stamp) of a commercial instrument which was used in the later described Experiments and Examples of the present invention.

In order to provide a sample image to be evaluated with respect to red reproduction, there were used two kinds of image evaluation test charts: Red Reproduction Evaluation Chart RL-1 Part No. FY9-9093 of CANON KABUSHIKI KAISHA which contains a plurality of 5 mm diameter red dots each having an optical density of 0.45 printed with a red ink having a spectral reflection factor equivalent to that of a vermilion inkpad for a commercial instrument shown in FIG. 5 and Image Evaluation Chart NA-7 Part No. FY9-9060 of CANON KABUSHIKI KAISHA which contains a plurality of 5 mm diameter black dots each having an optical density of 0.3. And, said RL-1 Chart and said NA-7 chart were arranged in parallel on the contact glass plate 211 and the electrophotographic image-forming process was conducted so as to obtain a copied image of which copied dots corresponding the printed black dots of said NA-7 chart having an optical density of 0.5.

And the image density of the copied dots corresponding to the printed red dots of said RL-1 chart in the resultant copied image was evaluated.

The evaluation of red reproduction for a copied image was made with a criterion whether the reproduced dots corresponding to the printed red dots of the original are equivalent to the reproduced dots corresponding to the printed black dots of the original in an appropriate copied image.

Evaluated results with respect to red reproduction for the three cases were as shown in Table 2.

Then in order to evaluate the situation of appearance of a ghost on a copied image, there were provided two kinds of test charts: Ghost Test Chart FY9-9040 of CANON KABUSHIKI KAISHA and Half Tone Test Chart FY9-9042 of CANON KABUSHIKI KAISHA.

These two test charts were appropriately arranged on the contact glass plate 211, and the electrophotographic image-forming process was carried out in the same way as in the above case to obtain a copied image.

The copies image thus obtained was evaluated with respect to the situation of a ghost appeared thereon, that is, of whether the reproduced characters of said Ghost Test Chart are distinct in a copied half tone image accompanied with ghosts.

Evaluated results with respect to ghost for the three cases were as shown in Table 2.

In any of the above evaluation cases, there was measured a lighting electric power by which an appropriate copied image can be obtained and it was observed of whether the electric power applied is in the permissible range. As a result, the following facts have been found: in the case of using the light having a wavelength in the region of 400 to 700 nm wherein an additional long wavelength light cutoff filter (a pair of long wavelength cutoff filters) is used, the lighting electric power is 65 V and therefore, the electric power consumption is in the permissible range; in the case of using the light having a wavelength in the region of 400 to 600 nm wherein two additional long wavelength light cutoff filters (two pairs of long wavelength cutoff filters) are used, the lighting electric power is as high as 70 V and the electric power consumption unavoidably becomes great beyond the permissible range; in the case of using the light having a wavelength in the region of 400 to 800 nm wherein any additional long wavelength light cutoff filter is not used, the lighting electric power is 60 V and the electric power consumption is small.

The findings were also described in Table 2.

From the results shown in Table 2, it has been found that the wavelength region for the light from the halogen lamp light source with which the cylindrical photosensitive member is irradiated in the electrophotographic image-forming process where said photosensitive member becomes desirably sensitive against the exposure light to thereby provide desirable red reproduction for a copied image obtained with a permissible electric power consumption is of 400 to 700 nm.

It has been also found that the appearance of a ghost on a copied image obtained is remarkably decreased with 0.3 or more in optical density when desirable reproduction is provided.

Figure 9:
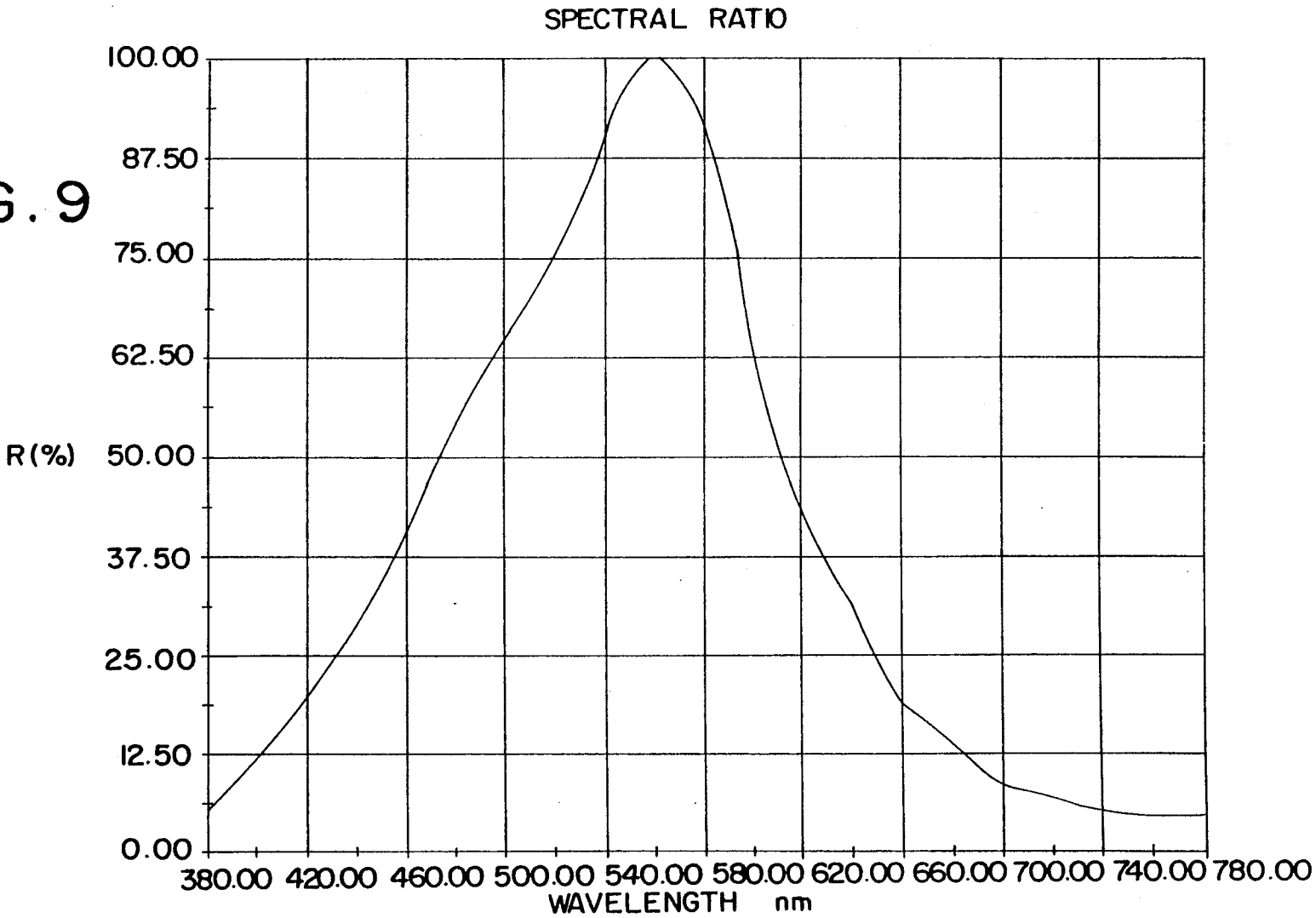
FIG. 9 is a graph of the spectral ratio of a light from the halogen lamp light source just before being projected through the lens system containing a long wavelength light cutoff filter onto a cylindrical photosensitive member sample in the later described Experiments.

In view of the above, in Experiments 1, 2, 4 and 5, the light from the halogen lamp light source 210 with which the cylindrical photosensitive member is exposed was adjusted to be of a wavelength in the region of 400 to 700 nm as shown in FIG. 9 using a proper long wavelength light cutoff filter.

EXPERIMENT 4

There were provided a plurality of cylindrical photosensitive member samples, each of which being distinguished one from another with respect to the refractive index based on the content of carbon atoms in the surface layer.

That is, each of said plurality of cylindrical photosensitive member samples comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing A-SiC:H material which has a refractive index in the range of 1.7 to 2.5 and a layer thickness of 4000 Å being laminated in this order on the surface of said aluminum cylinder For each of the cylindrical photosensitive members thus provided, there were conducted evaluations on the basic characteristics including Vickers hardness (surface hardness) and the residual potential thereof as the photosensitive member in the electrophotographic image-forming process according to the present invention.

As for the Vicker's hardness, it was measured in accordance with the method prescribed in JIS.

As for the residual potential, it was evaluated in the same manner as in Experiment 1.

Figure 6A:
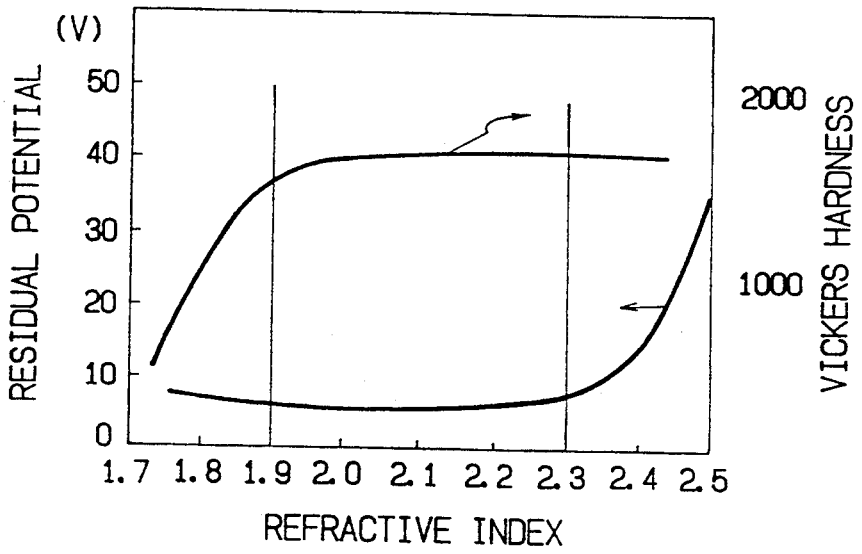
FIG. 6(A) and FIG. 6(B) are graphs respectively showing the examined results on the interrelations among the refractive index, residual potential and Vickers hardness for the surface layer of an amorphous silicon photosensitive member which were obtained in the later described Experiments.

The results obtained were as shown in FIG. 6(A).

From the results shown in FIG. 6(A), it has been recognized that for those cylindrical photosensitive members having a refractive index in the range of less than 1.9 with their surface layer (in other words, in the case where the content ratio of carbon atoms to silicon atoms in their surface layer being large), there is a tendency for the hardness of their surface layer to decrease and there will sometimes occur a problem particularly upon repeated use for a long period of time.

In addition, it has been recognized that for those cylindrical photosensitive members having a refractive index exceeding a value of 2.3 for their surface layer (in other words, the content ratio of carbon atoms to silicon atoms in their surface layer being small), there is a tendency for their surface layer to be highly resistant and for the residual potential to increase and there will sometimes occur potential shift upon repeated use for a long period of time.

EXPERIMENT 5

There were provided two sample groups each containing 42 different cylindrical photosensitive member samples Each of the 42 different cylindrical photosensitive member samples belonging to one sample group comprises an aluminum cylinder 101 of 108 mm in diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material which has a refractive index of 3.2 and a surface layer 104 composed of the foregoing A-SiC:H material which has a refractive index of 1.8, 1.9, 2.0, 2.1, 2.2 or 2.3 and a thickness of 4000, 5000, 6000, 7000, 8000, 9000 or 10000 Å being laminated in this order on the surface of said aluminum cylinder.

Each of the 42 different cylindrical photosensitive member samples belonging to another sample group comprises an aluminum cylinder 101 of 108 mm in diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material which has a refractive index of 3.5 and a surface layer 104 composed of the foregoing A-SiC:H material which has a refractive index of 1.8, 1.9, 2.0, 2.1, 2.2 or 2.3 and a thickness of 4000, 5000, 6000, 7000, 000, 9000 or 10000 Å being laminated in this order on the surface of said aluminum cylinder.

Figure 8:
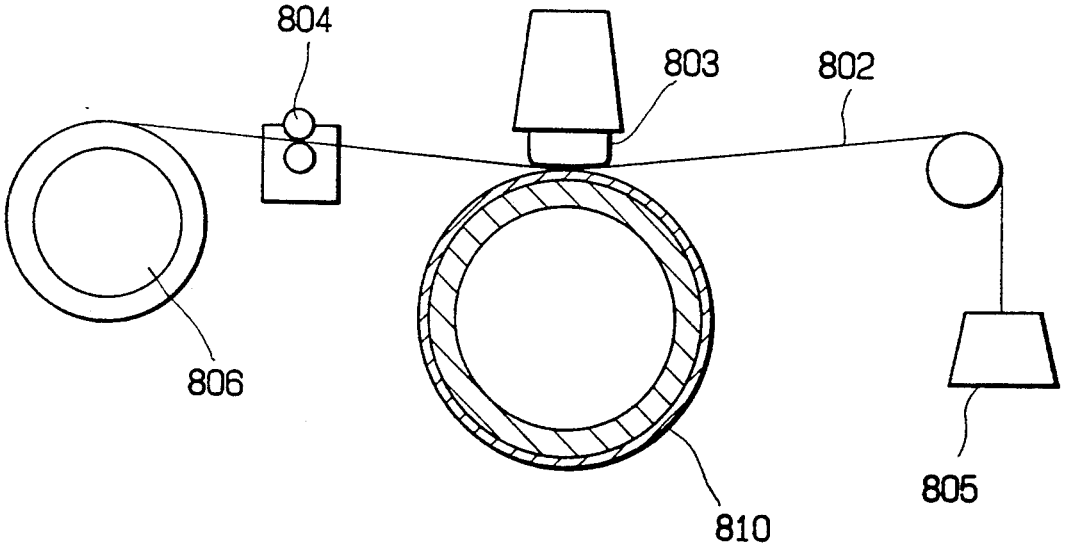
FIG. 8 is a schematic view illustrating the constitution of a conventional rotary grinding device which is used for rubbing off the surface layer of a cylindrical photosensitive member sample in the later described Experiments.

Each of the cylindrical photosensitive member samples was subjected to a conventional rotary grinding device as shown in FIG. 8 (which is disclosed in Japanese unexamined patent publication Sho.62(1987)-188665), where the surface layer was rubbed out at a cutting speed of 10 Å /min. Each time when the said surface layer was rubbed out by the thickness of 100 Å, the cylindrical photosensitive member sample was subjected to evaluation.

That is, for example, as for the cylindrical photosensitive member sample having the surface layer of 8000 Å in thickness, the procedures of Experiment 3 for evaluating the red reproduction and the situation of ghost appearance were carried out firstly on the said cylindrical photosensitive member, then on the said cylindrical photosensitive member of which surface layer being rubbed out by the thickness of 100 Å wherein a light from the halogen lamp light source 210 with which the cylindrical photosensitive member is exposed was adjusted to be of a wavelength in the region of 400 to 700 nm without using any additional long wavelength light cutoff filter. In this way, the above evaluations were made till the said cylindrical photosensitive member of which surface layer being reduced to 7100 Å in thickness.

The remaining cylindrical photosensitive member samples of which surface layer thickness being 5000, 6000, 7000, 9000 or 10000 Å were also evaluated in the same way as the above.

As for the cylindrical photosensitive member samples of which surface layer thickness being 4000 Å, they were evaluated without carrying out the foregoing rubbing out treatment.

Here, explanation is to be made on the rotary grinding device shown in FIG. 8. In the figure, numeral reference 810 stands for the surface layer 810 of a cylindrical photosensitive member to be treated and numeral reference 802 stands for a rubbing tape LT-2000 which has a fixed coat comprising SiC fine particles thereon (product of Fuji Photo Film Co., Ltd.). In the rubbing out treatment by this device, the rubbing tape 802 on a winding roller 806 is pulled and conveyed through a conveying speed controlling mechanism 804 onto the surface 810 of the cylindrical photosensitive member by a weight 805, where the said surface is rubbed out while applying a load of about 800 g by a pressing means 803.

The evaluated results obtained were shown in Tables 3 and 4. In more detail in this respect, in Table 3, there were collectively shown the evaluated results in terms of optical density for the evaluation item of red reproduction and of the situation of appeared ghost in relation to the thickness (d) and the refractive index (n) of the surface layer for the cylindrical photosensitive member samples respectively having a photoconductive layer of 3.2 in refractive index (n). And in Table 4, there were collectively shown the evaluated results in terms of optical density for the evaluation item of red reproduction and of the situation of appeared ghost in relation to the thickness (d) and the refractive index (n) of the surface layer for the cylindrical photosensitive member samples respectively having a photoconductive layer of 3.5 in refractive index (n).

Figure 7:
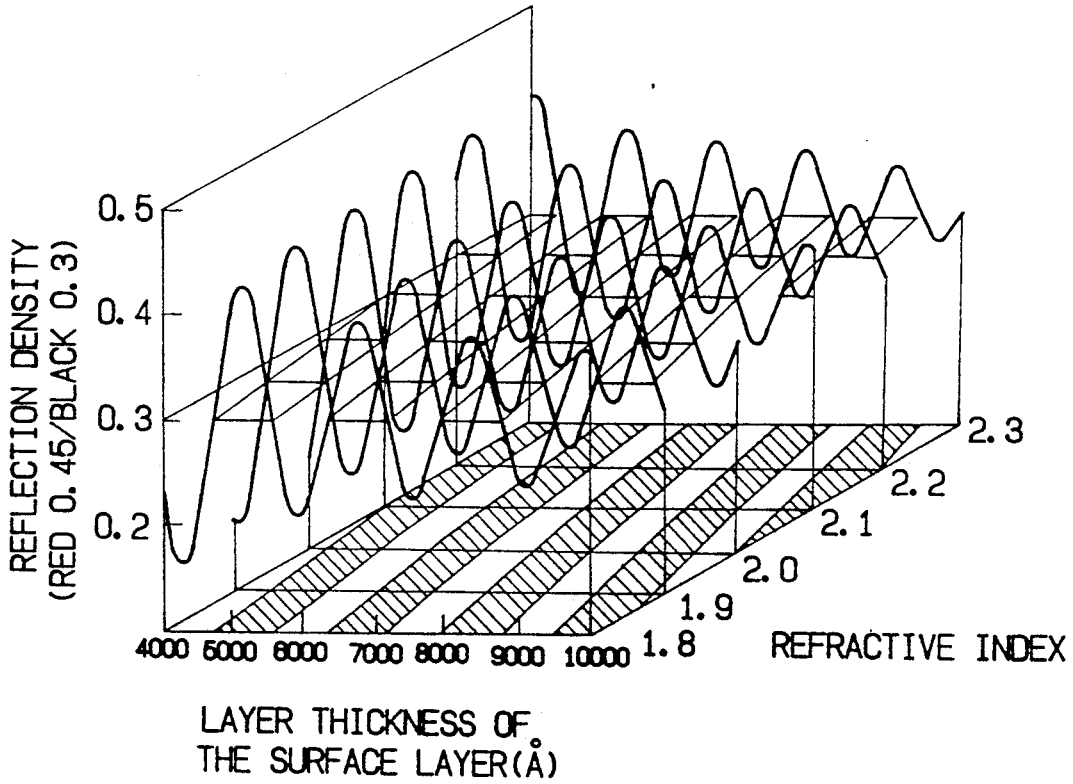
FIG. 7 is a schematic three dimensional stereoscopic graph of the examined results on the interrelations among the layer thickness, refractive index and red reproduction (optical density of a red-colored image) for amorphous silicon cylindrical photosensitive member samples which were used in the later described Experiments.

The evaluated results for red reproduction shown in Tables 3 and 4 were summarized by a three dimensional stereoscopic graph in relation to the thickness (d) and the refractive index (n) of the surface layer as shown in FIG. 7, in which the solid curved line relating to the refractive index (n) of the surface layer is one that was obtained by approximating the plots concerning red reproduction in relation to the thickness (d) of the surface layer.

The lighting electric power applied for the halogen lamp light source 210 was examined in the electrophotographic image-forming process for each cylindrical photosensitive member sample.

As a result, it has been found that for certain cylindrical photosensitive member samples, there is provided desirable red production without appearance of undesirable ghost on a copied image with the application of a lighting electric power which is practically acceptable.

In this case, it has been recognized that the surface layer of the cylindrical photosensitive member desirably functions to cut off such a long wavelength light as hindering a desirable image formation.

Now, from the results shown in Tables 3 and 4 and also from the three dimensional stereoscopic graph shown in FIG. 7, the following facts have been recognized. That is, representatively referring to the cylindrical photosensitive member samples respectively having the surface layer of 2.0 in refractive index, there is found a good red reproduction peak near 4700 Å, near 6100 Å, near 7600 Å, and near 9000 Å respectively with respect to the thickness of the surface layer.

On the other hand, in any of the cases where the thickness of the surface layer is in the range of 4000 Å to about 4300 Å or less, in the range of about 5100 to about 5700 Å, in the range of about 6500 to about 7200 Å, in the range of about 8000 to about 8600 Å or in the range of about 9400 to about 10000 Å, there is found poor red reproduction wherein undesirable ghost appears.

The situation similar to this is also found on the remaining cylindrical photosensitive member samples respectively having the surface layer of 1.9, 2.1, 2.2 or 2.3 in refractive index.

As a result of further studies based on the various findings obtained through the foregoing Experiment 1 to 5, the present inventors have found that the object of the present invention can be effectively attained with an electrophotographic image-forming process which meets the following conditions:

(i) that a specific amorphous silicon system photosensitive member is used: said photosensitive member comprises a substrate and a light receiving layer which comprises a 0.01 to 10 μm thick charge injection inhibition layer composed of an amorphous material containing silicon atoms as the matrix, hydrogen atoms and valence electron controlling atoms, a 1 to 100 μm thick photoconductive layer of 3.2 to 3.5 in refractive index composed of an amorphous material containing silicon atoms as the matrix and at least hydrogen atoms and a 4000 to 10000 Å (0.4 to 1 μm) thick surface layer of 1.9 to 2.3 in refractive index composed of an amorphous material containing silicon atoms, carbon atoms and hydrogen atoms (hereinafter referred to as "A-SiC:H"): said A-SiC:H material to constitute said surface layer is a member selected from the group consisting of A-SiC:H materials ranging in one of the following five ranges (i) to (v): (i) range of $D_1$–$D_2$, (ii) range of $D_3$–$D_4$, (iii) range of $D_5$–$D_6$, (iv) range of $D_7$–$D_8$ (v) range of $D_9$–$D_{10}$, where the value of each D is obtained by the following equation (I) relating to the refractive index-depending linear line of a critical red reproduction thickness of the surface layer:

$$D_K = A_K X\ n + B_K \quad (I)$$

where $4000 < D_K \leqq 10000$, K is an integer of 1 to 10.

$A_K = -a_K \times 0.462 - 60$ ($A_K$ is an inclination of said linear line).

$B_K = 1.924 \times a_K + 120$ ($B_K$ is an intercept of $D_K$), and

| | |
|---|---|
| $a_1 = 4300$ | $a_2 = 5100$ |
| $a_3 = 5700$ | $a_4 = 6500$ |
| $a_5 = 7200$ | $a_6 = 8000$ |
| $a_7 = 8600$ | $a_8 = 9400$ |
| $a_9 = 10000$ | $a_{10} = 10800$ |

(ii) that a image-forming light having a continuous wavelength in the region of from 400 to 700 nm from a halogen lamp light source is used, (iii) that a magnet roller capable of forming a toner brush comprising magnetic materials of magnetic toner is used as the cleaning means, and (iv) that an image-forming process is carried out at a process speed 450 mm/sec. or more.

EXPERIMENT 6

There were provided a plurality of cylindrical photosensitive member samples, each of which being distinguished with the thickness of the surface layer.

That is, each of said plurality of cylindrical photosensitive member samples comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing specific A-SiC:H material which has a refractive index of 1.9 and a layer thickness in the range of 6000 to 11000 Å being laminated in this order on the surface of said aluminum cylinder.

Each of the cylindrical photosensitive member samples thus provided was evaluated with respect to residual potential using the electrophotographic copying apparatus shown in FIG. 2(B) in the following manner.

Firstly, the cylindrical photosensitive member was rotated and maintained at an image-forming process speed of 560 mm/sec. The cylindrical photosensitive member was uniformly charged by the main corona charger 202 to which a high voltage of +6 to +8 KV being applied. Then, the foregoing image-forming process was carried out, wherein the dark surface potential of the cylindrical photosensitive member sample was measured by a conventional electrostatic voltmeter Model 244 (product of Monroe Electronics, Inc.) both at the position of the first development mechanism 204-1 and at the position of the second development mechanism 204-2 to obtain a value of 400 V at the position of the first development mechanism 204-1. Thereafter, the main corona charger 202 was switched off, and the successive image-forming process was carried out, wherein the dark surface potential of the cylindrical photosensitive member sample was measured in the same manner as in the previous case to thereby evaluate the residual potential of the cylindrical photosensitive member sample.

Figure 4B:
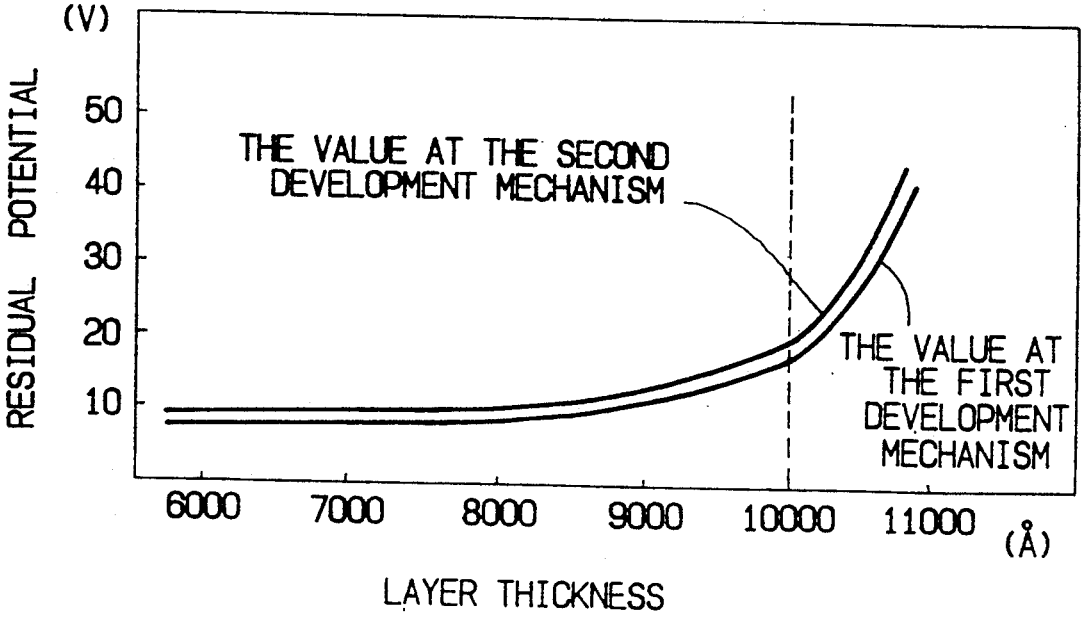

The results obtained were as shown in FIG. 4(B).

From the results shown in FIG. 4(B), it has been found that the residual potential shows a tendency of providing an acceptable value both at the position of the first development mechanism 204-1 and at the position of the second development mechanism 204-2 for any of the cylindrical photosensitive member samples a A-SiC:H surface layer of up to 10000 Å, but there is a tendency for any of those cylindrical photosensitive member samples having a A-SiC:H surface layer of a thickness exceeding 10000 Å to relatively increase with respect to the residual potential and because of this, such cylindrical photosensitive member is not suited for effectively attaining the object of the present invention.

EXPERIMENT 7

There were provided a plurality of cylindrical photosensitive member samples, each of which being distinguished with the refractive index and the thickness of the surface layer.

That is, each of said plurality of cylindrical photosensitive member samples comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing A-SiC:H material which has a refractive index in the range of 1.8 to 2.3 and a layer thickness in the range of 6000 to 10000 Å being laminated in this order on the surface of said aluminum cylinder.

Each of the cylindrical photosensitive member samples thus provided was evaluated with respect to occurrence of uneven image density caused by uneven sensitivity on a copied image using the electrophotographic copying apparatus shown in FIG. 2(B) wherein as the cleaning roller 220, a magnet roller or an elastic gum roller was used and both the first development mechanism 204-1 and the second development mechanism 204-2 were charged with black magnetic toner.

In the evaluation, using a whole half tone original, the electrophotographic copying process was carried out intermittently for a A-4 size transfer sheet while using the said first and second development mechanisms one after the other and making a predetermined interval after every electrophotographic image-forming process, and after 500,000 copies being made, there was observed occurrence of uneven image density caused by uneven sensitivity of the cylindrical photosensitive member sample on a copied image.

The results obtained were as shown in Table 5.

From the results shown in Table 5, it has been found that there is obtained a desirable result to effectively attain the object of the present invention when a magnet roller as the cleaning means and a cylindrical photosensitive member having a 4000 Å or more thick surface layer composed of the foregoing A-SiC:H material, the refractive index of which being in the range of 1.8 to 2.3, are used in combination.

In addition, any occurrence of smeared image was not observed in any case. Further, with respect to the thickness of the surface layer for each of the cylindrical photosensitive member samples, after 100,000 copies being continuously made, there was observed a 300 to 1000 Å abrasion in the case of using the elastic gum roller but a distinguishable abrasion was not observed in the case of using the magnet roller.

In conclusion from the results obtained in Experiments 6 and 7, it has been recognized that a desirable result to effectively attain the object of the present invention is obtained when a cylindrical photosensitive member having a 4000 to 10000 Å thick surface layer composed of the foregoing A-SiC:H material, the refractive index of which being in the range of 1.8 to 2.3 and a magnet roller are used in combination in the electrophotographic image-forming process.

EXPERIMENT 8

In this experiment, the cylindrical photosensitive member to be used in the electrophotographic image-forming process according to the present invention was evaluated in the view points of red reproduction and appearance of a ghost for an image obtained and a lighting electric power for the halogen lamp light source 210 for obtaining a pertinent red reproduction.

There was provided a cylindrical photosensitive member sample which comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing A-SiC:H material which has a refractive index of 1.9 and a layer thickness of 5000 Å being laminated in this order on the surface of said aluminum cylinder.

The cylindrical photosensitive member thus provided was set to the electrophotographic copying apparatus shown in FIG. 2(B) and it was irradiated with a light from the halogen lamp light source 210 being adjusted with its wavelength to be in the region of 400 to 600 nm or in the region of 400 to 700 nm using one or more additional long wavelength light cutoff filters in addition to the filter 218 or with a light from the halogen lamp light source 210 being adjusted to be in the region of 400 to 800 without using such additional filter in the electrophotographic image-forming process in order to evaluate the situation of red reproduction on an image obtained.

In each case, at the time of irradiating the cylindrical photosensitive member with the above light, a lighting power for the halogen lamp was properly adjusted so as to obtain an appropriate image.

In order to provide a sample image to be evaluated with respect to red reproduction, there were used two kinds of image evaluation test charts: Red Reproduction Evaluation Chart RL-1 Part No. FY9-9093 of CANON KABUSHIKI KAISHA which contains a plurality of 5 mm diameter red dots each having an optical density of 0.45 printed with a red ink having a spectral reflection factor equivalent to that of a vermilion inkpad for a commercial instrument shown in FIG. 5 and Image Evaluation Chart NA-7 Part No. FY9-9060 of CANON KABUSHIKI KAISHA which contains a plurality of 5 mm diameter black dots each having an optical density of 0.3. And, said RL-1 Chart and said NA-7 chart were arranged in parallel on the contact glass plate 211 and the electrophotographic image-forming process was conducted so as to obtain a copied image of which copied dots corresponding the printed black dots of said NA-7 chart having an optical density of 0.5.

In this case, there was used only the first development mechanism 204-1 charged with black magnetic toner which is situated under much severe condition in view of red production since it is much influenced by the increased charge quantity and the increased quantity of an image-forming light.

In the above electrophotographic image-forming process, a copied image was obtained in the following way: in the first electrophotographic image-forming process cycle, said NA-7 chart was copied while extinguishing the electrostatic image corresponding to said RL-1 chart by means of the blank exposure source 229 and in the second electrophotographic image-forming process cycle, said RL-1 chart was copied in the same way as the above.

And the image density of the copied dots corresponding to the printed red dots of said RL-1 chart in the resultant copied image was evaluated.

The evaluation of red reproduction for a copied image was made with a criterion whether the reproduced dots corresponding to the printed red dots of the original are equivalent to the reproduced dots corresponding to the printed black dots of the original in an appropriate copied image.

Evaluated results with respect to red reproduction for the three cases were as shown in Table 6.

Then in order to evaluate the situation of appearance of a ghost on a copied image, there were provided two kinds of test charts: Ghost Test Chart FY9-9040 of CANON KABUSHIKI KAISHA and Half Tone Test Chart FY9-9042 of CANON KABUSHIKI KAISHA.

These two test charts were appropriately arranged on the contact glass plate 211, and the electrophotographic image-forming process was carried out in the same way as in the above case to obtain a copied image.

The copies image thus obtained was evaluated with respect to the situation of a ghost appeared thereon, that is, of whether the reproduced characters of said Ghost Test Chart are distinct in a copied half tone image accompanied with ghosts.

Evaluated results with respect to ghost for the three cases were as shown in Table 6.

In any of the above evaluation cases, there was measured a lighting electric power by which an appropriate copied image can be obtained and it was observed of whether the electric power applied is in the permissible range. As a result, the following facts have been found: in the case of using the light having a wavelength in the region of 400 to 700 nm wherein an additional long wavelength light cutoff filter (a pair of long wavelength cutoff filters) is used, the lighting electric power is 65 V and therefore, the electric power consumption is in the permissible range; in the case of using the light having a wavelength in the region of 400 to 600 nm wherein two additional long wavelength light cutoff filters (two pairs of long wavelength cutoff filters) are used, the lighting electric power is as high as 70 V and the electric power consumption unavoidably becomes great beyond the permissible range; in the case of using the light having a wavelength in the region of 400 to 800 nm wherein any additional long wavelength light cutoff filter is not used, the lighting electric power is 60 V and the electric power consumption is small.

The findings were also described in Table 6.

From the results shown in Table 6, it has been found that the wavelength region for the light from the halogen lamp light source with which the cylindrical photosensitive member is irradiated in the electrophotographic image-forming process, where said photosensitive member becomes desirably sensitive against the exposure light to thereby provide desirable red reproduction for a copied image obtained with a permissible electric power consumption is of 400 to 700 nm.

It has been also found that the appearance of a ghost on a copied image obtained is remarkably decreased with 0.3 or more in optical density when desirable reproduction is provided.

In view of the above, in Experiments 6, 7, 9 and 10, the light from the halogen lamp light source 210 with which the cylindrical photosensitive member is exposed was adjusted to be of a wavelength in the region of 400 to 700 nm as shown in FIG. 9 using a proper long wavelength light cutoff filter.

EXPERIMENT 9

There were provided a plurality of cylindrical photosensitive member samples, each of which being distinguished one from another with respect to the refractive index based on the content of carbon atoms in the surface layer.

That is, each of said plurality of cylindrical photosensitive member samples comprises an aluminum cylinder 101 of 108 mm in outer diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material and a surface layer 104 composed of the foregoing A-SiC:H material which has a refractive index in the range of 1.7 to 2.5 and a layer thickness of 4000 Å being laminated in this order on the surface of said aluminum cylinder.

For each of the cylindrical photosensitive members thus provided, there were conducted evaluations on the basic characteristics including Vickers hardness (surface hardness) and the residual potential thereof as the photosensitive member in the electrophotographic image-forming process according to the present invention.

As for the Vicker's hardness, it was measured in accordance with the method prescribed in JIS.

As for the residual potential, it was evaluated in the same manner as in Experiment 6.

Figure 6B:
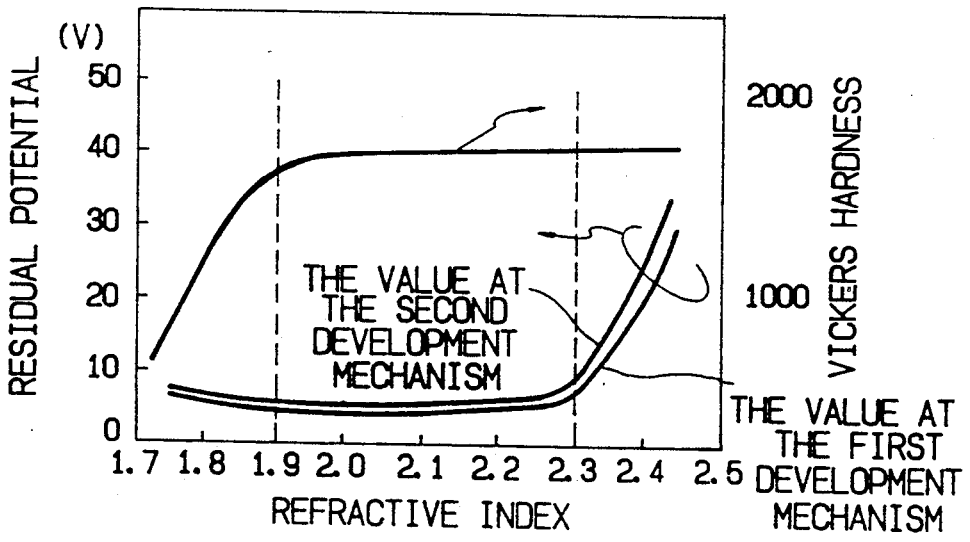

The results obtained were as shown in FIG. 6(B).

From the results shown in FIG. 6(B), it has been recognized that for those cylindrical photosensitive member samples having a refractive index in the range of less than 1.9 with their surface layer (in other words, in the case where the content ratio of carbon atoms to silicon atoms in their surface layer being large), there is a tendency for the hardness of their surface layer to decrease and there will sometimes occur a problem particularly upon repeated use for a long period of time.

In addition, it has been recognized that for those cylindrical photosensitive member samples having a refractive index exceeding a value of 2.3 for their surface layer (in other words, the content ratio of carbon atoms to silicon atoms in their surface layer being small), there is a tendency for their surface layer to be highly resistant and for the residual potential to increase and there will sometimes occur potential shift upon repeated use for a long period of time.

EXPERIMENT 10

There were provided two sample groups each containing 42 different cylindrical photosensitive member samples. Each of the 42 different cylindrical photosensitive member samples belonging to one sample group comprises an aluminum cylinder 101 of 108 mm in diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material which has a refractive index of 3.2 and a surface layer 104 composed of the foregoing A-SiC:H material which has a refractive index of 1.8, 1.9, 2.0, 2.1, 2.2 or 2.3 and a thickness of 4000, 5000, 6000, 7000, 8000, 9000 or 10000 Å being laminated in this order on the surface of said aluminum cylinder.

Each of the 42 different cylindrical photosensitive member samples belonging to another sample group comprises an aluminum cylinder 101 of 108 mm in diameter, 360 mm in length and 5 mm in thickness which has a mirror ground surface and a light receiving layer comprising a 3 μm thick charge injection inhibition layer 102 composed of a A-Si material containing 1000 ppm of boron atoms, a 27 μm thick photoconductive layer 103 composed of a non-doped A-Si:H material which has a refractive index of 3.5 and a surface layer 104 composed of the foregoing A-SiC:H material which has a refractive index of 1.8, 1.9, 2.0, 2.1, 2.2 or 2.3 and a thickness of 4000, 5000, 6000, 7000, 8000, 9000 or 10000 Å being laminated in this order on the surface of said aluminum cylinder.

Each of the cylindrical photosensitive member samples was subjected to the foregoing conventional rotary grinding device as shown in FIG. 8, where the surface layer was rubbed out at a cutting speed of 10 Å/min. Each time when the said surface layer was rubbed out by the thickness of 100 Å, the cylindrical photosensitive member sample was subjected to evaluation.

That is, for example, s for the cylindrical photosensitive member sample having the surface layer of 8000 Å in thickness, the procedures of Experiment 8 for evaluating the red reproduction and the situation of ghost appearance were carried out firstly on the said cylindrical photosensitive member, then on the said cylindrical photosensitive member of which surface layer being rubbed out by the thickness of 100 Å wherein a light from the halogen lamp light source 210 with which the cylindrical photosensitive member is exposed was adjusted to be of a wavelength in the region of 400 to 700 nm without using any additional long wavelength light cutoff filter. In this way, the above evaluations were made till the said cylindrical photosensitive member of which surface layer being reduced to 7100 Å in thickness.

The remaining cylindrical photosensitive member samples of which surface layer thickness being 5000, 6000, 7000, 9000 or 10000 Å were also evaluated in the same way as the above.

As for the cylindrical photosensitive member samples of which surface layer thickness being 4000 Å, they were evaluated without carrying out the foregoing rubbing out treatment.

In any of the above cases, the electrophotographic image-forming process was carried out using only the first development mechanism because of the same reason as described in Experiment 8.

The evaluated results obtained were shown in Tables 7 and 8. In more detail in this respect, in Table 7, there were collectively shown the evaluated results in terms of optical density for the evaluation item of red reproduction and of the situation of appeared ghost in relation to the thickness (d) and the refractive index (n) of the surface layer for the cylindrical photosensitive member samples respectively having a photoconductive layer of 3.2 in refractive index (n). And in Table 8, there were collectively shown the evaluated results in terms of optical density for the evaluation item of red reproduction and of the situation of appeared ghost in relation to the thickness (d) and the refractive index (n) of the surface layer for the cylindrical photosensitive member samples respectively having a photoconductive layer of 3.5 in refractive index (n).

The evaluated results for red reproduction shown in Tables 7 and 8 were summarized by a three dimensional stereoscopic graph in relation to the thickness (d) and the refractive index (n) of the surface layer in the same way as in the case of Experiment 5.

As a result, the resultant three dimensional stereoscopic graph became almost equivalent to that obtained in Experiment 5.

The lighting electric power applied for the halogen lamp light source 210 was examined in the electrophotographic image-forming process for each cylindrical photosensitive member sample.

As a result, it has been found that for certain cylindrical photosensitive member samples, there is provided desirable red production without appearance of undesirable ghost on a copied image with the application of a lighting electric power in the range of 64 to 66 V which is practically acceptable.

In this case, it has been recognized that the surface layer of the cylindrical photosensitive member desirably functions to cut off such a long wavelength light as hindering a desirable image formation.

Now, from the results shown in Tables 7 and 8 and also from the resultant three dimensional stereoscopic graph, the following facts have been recognized. That is, representatively referring to the cylindrical photosensitive member samples respectively having the surface layer of 2.0 in refractive index, there is found a good red reproduction peak near 4700 Å, near 6100 Å, near 7600 Å, and near 9000 Å respectively with respect to the thickness of the surface layer.

On the other hand, in any of the cases where the thickness of the surface layer is in the range of 4000 Å to about 4300 Å or less, in the range of about 5100 to about 5700 Å, in the range of about 6500 to about 7200 Å, in the range of about 8000 to about 8600 Å or in the range of about 9400 to about 10000 Å, there is found poor red reproduction wherein undesirable ghost appears.

The situation similar to this is also found on the remaining cylindrical photosensitive member samples respectively having the surface layer of 1.9, 2.1, 2.2 or 2.3 in refractive index.

As a result of further studies based on the various findings obtained through the foregoing Experiment 6 to 10, the present inventors have found that the object of the present invention can be effectively attained with an electrophotographic image-forming process which meets the following conditions:

(i) that a specific amorphous silicon system photosensitive member is used: said photosensitive member comprises a substrate and a light receiving layer which comprises a 0.01 to 10 μm thick charge injection inhibition layer composed of an amorphous material containing silicon atoms as the matrix, hydrogen atoms and valence electron controlling atoms, a 1 to 100 μm thick photoconductive layer of 3.2 to 3.5 in refractive index composed of an amorphous material containing silicon atoms as the matrix and at least hydrogen atoms and a 4000 to 10000 Å (0.4 to 1 μm) thick surface layer of 1.9 to 2.3 in refractive index composed of an amorphous material containing silicon atoms, carbon atoms and hydrogen atoms (hereinafter referred to as "A-SiC:H"): said A-SiC:H material to constitute said surface layer is a member selected from the group consisting of A-SiC:H materials ranging in one of the following five ranges (i) to (v); (i) range of $D_1$–$D_2$, (ii) range of $D_3$–$D_4$, (iii) range of $D_5$–$D_6$, (iv) range of $D_7$–$D_8$ and (v) range of $D_9$–$D_{10}$, where the value of each D is obtained by the following equation (I) relating to the refractive index-depending linear line of a critical red reproduction thickness of the surface layer:

$$D_K = A_K X\ n + B_K \qquad \text{(I)}$$

where $4000 < D_K < 10000$, K is an integer of 1 to 10, $A_K = -a_K X\ 0.462 - 60$ ($A_K$ is an inclination of said linear line), $B_K = 1.924\ X\ a_K + 120$ ($B_K$ is an intercept of $D_K$), and

| | |
|---|---|
| $a_1 = 4300$ | $a_2 = 5100$ |
| $a_3 = 5700$ | $a_4 = 6500$ |
| $a_5 = 7200$ | $a_6 = 8000$ |
| $a_7 = 8600$ | $a_8 = 9400$ |
| $a_9 = 10000$ | $a_{10} = 10800$ |

(ii) that a image-forming light having a continuous wavelength in the region of from 400 to 700 nm from a halogen lamp light source is used, and (iii) that a magnet roller capable of forming a toner brush comprising magnetic materials of magnetic toner is used as the cleaning means.

DESCRIPTION OF THE PREFERRED EMBODIMENTS

The present invention will be described more specifically, but the present invention is not intended to limit the scope only to these examples.

EXAMPLE 1

There was provided a cylindrical photosensitive member having the configuration shown in FIG. 1 which comprises a JIS 5000 system aluminum cylinder and a light receiving layer comprising a charge injection inhibition layer composed of A-Si:B:H material, a photoconductive layer composed of A-Si:H material and a surface layer composed of A-SiC:H material being laminated in this order, details of which being described in Table 9, which was prepared by glow discharge decomposition method as disclosed in U.S. Pat. No. 4,738,913.

As the electrophotographic copying apparatus, there was provided a partial modification of Canon's NP-8570 Electrophotographic Copying Machine (product by CANON KABUSHIKI KAISHA) having the constitution similar to that of the electrophotographic copying apparatus shown in FIG. 2(A), with which a higher high frequency oscillator for controlling motor-rotation speed being provided in order to make it possible to provide an image-forming process speed of 560 mm/sec. which corresponds a copying speed of 90 copies per minute The above-mentioned cylindrical photosensitive member was set to said modified electrophotographic copying machine, and the electrophotographic image-forming process was carried out in the same manner as in Experiment 3 using the foregoing Red Reproduction Evaluation Chart RL-1 and Image Evaluation Chart NA-7 so that the 5 mm diameter printed black dot having an optical density 0.3 of said NA-7 chart be reproduced as a desirable 5 mm diameter black dot having an optical density of 0.5, to thereby obtain a copied image containing a 5 mm diameter black dot corresponding to the printed red dot of said RL-1 chart having an optical density of 0.45 and a 5 mm diameter black dot corresponding to the 5 mm diameter printed black dot of said NA-7 chart.

The copied image thus obtained was evaluated in the same way as in Experiment 3. As a result, it has been found that the reproduced black dot corresponding to the printed red dot of said RL-1 chart is of an optical density of 0.38 and it is comparable to the reproduced black dot corresponding to the printed black dot of said NA-7 chart. In this respect, it has been recognized that red reproduction was desirably provided.

In addition, in order to evaluate the situation of appearance of a ghost on a reproduced image, there was carried out the electrophotographic image-forming process in the same manner as in Experiment 3 wherein the foregoing ghost test chart and half tone test chart are used, to thereby obtain a copied image.

The copied image thus obtained was evaluated in the same manner as in Experiment 3. As a result, it has been recognized that a desirable image without accompaniment of any undesirable ghost can be obtained with the use of the above cylindrical photosensitive member.

Further in addition, it has been found that the aforesaid desirable red reproduction is stably maintained even after the electrophotographic image-forming process cycle being continuously repeated 250,000 times.

COMPARATIVE EXAMPLE 1

The same procedures as in Example 1 were repeated except that the magnet roller of the electrophotographic copying machine used in Example 1 was replaced by a silicon rubber roller.

As a result, the following facts have been found: (1) after the electrophotographic image-forming process cycle being continuously repeated 250,000 times, the surface layer of the foregoing cylindrical photosensitive member was worn out by the thickness of 900 Å, (2) red reproduction was not so good as in the case of Example 1 even at the beginning stage and there was decreased to the level of 0.27 for the optical density of a reproduced image corresponding to the red original after the electrophotographic image-forming process cycle being continuously repeated 250,000 times, and (3) there was found appearance of undesirable ghosts on copied images.

COMPARATIVE EXAMPLE 2

In this case, there was provided a cylindrical photosensitive member having the configuration shown in FIG. 1 which comprises a JIS 5000 system aluminum cylinder and a light receiving layer comprising a charge injection inhibition layer composed of A-Si:B:H material, a photoconductive layer composed of A-Si:H material and a surface layer composed of A-SiC:H material being laminated in this order, details of which being described in Table 10, which was prepared by glow discharge decomposition method as disclosed in U.S. Pat. No. 4,738,913.

As the electrophotographic copying apparatus, there was used a further modified of the foregoing modified electrophotographic copying machine used in Example 1 with which a pair of soda glasses (CM-500) respectively of 2 mm in thickness being provided in addition to the long wavelength cutoff filter in the lens system in order to secure desirable red reproduction as in the case of Example 1.

Then, the same procedures as in Example 1 were repeated. As a result, although there were obtained similar results to those in Example 1, the lighting voltage was increased by 4 V which corresponds an increase of 20 W in terms of electric power, which is far beyond the permissible range of electric power consumption.

EXAMPLE 2

There was provided a cylindrical photosensitive member having the configuration shown in FIG. 1 which comprises a JIS 5000 system aluminum cylinder and a light receiving layer comprising a charge injection inhibition layer composed of A-Si:B:H material, a photoconductive layer composed of A-Si:H material and a surface layer composed of A-SiC:H material being laminated in this order, details of which being described in Table 11, which was prepared by glow discharge decomposition method as disclosed in U.S. Pat. No. 4,738,913.

As the electrophotographic copying apparatus, there was provided a partial modification of Canon's NP-5540 Electrophotographic Copying Machine of negative charge polarity type (product of CANON KABUSHIKI KAISHA) having the constitution similar to that of the electrophotographic copying apparatus shown in FIG. 2(B), which is so modified that a positive charge polarity type cylindrical photosensitive member can be used. In more detail in this respect, both the main charger and the transfer charger are changed to be of positive charge polarity type from negative charge polarity type, and both the first and second development mechanisms are charged with negative black magnetic toner.

The aforesaid cylindrical photosensitive member was set to this electrophotographic copying machine and the same procedures of Example 1 were repeated, except that the electrophotographic image-forming cycle was carried out using said two development mechanisms one after the other.

The resultant copied images were evaluated with respect to red reproduction in the same manner as in Example 1. As a result, it has been found that both the resultant copied image in the case of using the first development mechanism and the resultant copied image in the case of using the second development mechanism were respectively 0.39 and 0.40 for the optical density of the copied black image corresponding to the red original and excelling in red reproduction.

In addition, in order to evaluate the situation of appearance of a ghost on a reproduced image, the same procedures as in Example were carried out, except that the first and second development mechanisms were used one after the other as in the above case.

The resultant images were evaluated in the same manner as in Example 1. As a result, it has been recognized that a desirable image without accompaniment of any undesirable ghost can be obtained with the use of the above cylindrical photosensitive member in any of the two cases.

Further in addition, it has been found that the aforesaid desirable red reproduction is stably maintained even after the electrophotographic image-forming process cycle being continuously repeated 250,000 times.

COMPARATIVE EXAMPLE 3

The same procedures as in Example 2 were repeated except that the magnet roller of the electrophotographic copying machine used in Example 2 was replaced by a silicon rubber roller.

As a result, the following facts have been found: (1) after the electrophotographic image-forming process cycle being continuously repeated 250,000 times, the surface layer of the foregoing cylindrical photosensitive member was worn out by the thickness of 900 Å, (2) red reproduction was not so good as in the case of Example 2 even at the beginning stage and there was decreased to the respective levels of 0.26 and 0.28 respectively in the case of using the first development mechanism and in the case of using the second development mechanism for the optical density of a reproduced image corresponding to the red original after the electrophotographic image-forming process cycle being continuously repeated 250,000 times, and (3) there was found appearance of undesirable ghosts on copied images.

COMPARATIVE EXAMPLE 4

In this case, there was provided a cylindrical photosensitive member having the configuration shown in FIG. 1 which comprises a JIS 5000 system aluminum cylinder and a light receiving layer comprising a charge injection inhibition layer composed of A-Si:B:H material, a photoconductive layer composed of A-Si:H material and a surface layer composed of A-SiC:H material being laminated in this order, details of which being described in Table 12, which was prepared by glow discharge decomposition method as disclosed in U.S. Pat. No. 4,738,913.

As the electrophotographic copying apparatus, there was used a further modified of the foregoing modified electrophotographic copying machine used in Example 2 with which a pair of soda glasses (CM-500) respectively of 2 mm in thickness being provided in addition to the long wavelength cutoff filter in the lens system in order to secure desirable red reproduction as in the case of Example 2.

Then, the same procedures as in Example 2 were repeated. As a result, although there were obtained similar results to those in Example 2, the lighting voltage was increased by 5 V which corresponds an increase of 25 W in terms of electric power, which is far beyond the permissible range of electric power consumption.

TABLE 1

| Surface layer | | | Evaluation on uneven image |
|---|---|---|---|
| Layer thickness (A) | Refractive index (n) | Cleaning roller | density caused by uneven sensitivity |
| 3,500 | 1.9 | magnetic roller | Δ |
| 4,000 | 1.8 | magnetic roller | ○ |
| 4,000 | 1.9 | magnetic roller | ◎ |
| 4,000 | 2.0 | magnetic roller | ◎ |
| 4,000 | 2.3 | magnetic roller | ◎ |
| 10,000 | 1.9 | magnetic roller | ◎ |
| 4,000 | 1.9 | elastic gum | x |
| 5,000 | 1.9 | elastic gum | Δ |

◎: excellent
○: good
Δ: acceptable
x: poor

TABLE 2

| Wavelength region | Additional pair of filters | Lighting voltage | | Red reproduction (optical density) | | Evaluation on ghost appearance | Total evaluation |
|---|---|---|---|---|---|---|---|
| 400~600 nm | 2 pairs | 70 V | x | 0.35 | ○ | ○ | Δ |
| 400~700 nm | 1 pair | 65 V | ○ | 0.30 | ○ | ○ | ○ |

TABLE 2-continued

| Wavelength region | Additional pair of filters | Lighting voltage | Red reproduction (optical density) | Evaluation on ghost appearance | Total evaluation |
|---|---|---|---|---|---|
| 400 ~ 800 nm | no | 60 V ○ | 0.20 x | x | x |

Lighting voltage
○: permissible range
x: beyond permissible range
Red reproduction:
○: good
x: poor
Ghost:
○: permissible
x: not permissible
Total evaluation:
○: good
Δ: not good
x: poor

TABLE 3

| Surface layer thickness | Red Reproduction | | | | | | Ghost Appearance | | | | | |
|---|---|---|---|---|---|---|---|---|---|---|---|---|
| | $n_1$ | $n_2$ | $n_3$ | $n_4$ | $n_5$ | $n_6$ | $n_1$ | $n_2$ | $n_3$ | $n_4$ | $n_5$ | $n_6$ |
| 4000 A | .23 | .17 | .16 | .25 | .37 | .41 | X | X | X | X | O | O |
| 4100 A | .25 | .16 | .24 | .33 | .40 | .43 | X | X | X | O | O | O |
| 4200 A | .18 | .20 | .28 | .36 | .43 | .40 | X | X | X | O | O | O |
| 4300 A | .14 | .23 | .30 | .43 | .40 | .32 | X | X | O | O | O | O |
| 4400 A | .21 | .27 | .35 | .44 | .36 | .29 | X | X | O | O | O | X |
| 4500 A | .19 | .31 | .40 | .40 | .32 | .28 | X | O | O | O | O | X |
| 4600 A | .24 | .32 | .39 | .36 | .29 | .23 | X | O | O | O | X | X |
| 4700 A | .26 | .41 | .45 | .32 | .28 | .20 | X | O | O | O | X | X |
| 4800 A | .30 | .42 | .39 | .27 | .26 | .27 | O | O | O | X | X | X |
| 4900 A | .40 | .42 | .38 | .27 | .19 | .30 | O | O | O | X | X | O |
| 5000 A | .44 | .45 | .28 | .24 | .22 | .31 | O | O | X | X | X | O |
| 5100 A | .39 | .40 | .30 | .23 | .23 | .33 | O | O | O | X | X | O |
| 5200 A | .40 | .36 | .27 | .27 | .27 | .38 | O | O | X | X | X | O |
| 5300 A | .43 | .27 | .24 | .27 | .30 | .41 | O | X | X | X | O | O |
| 5400 A | .34 | .26 | .24 | .30 | .36 | .40 | O | X | X | O | O | O |
| 5500 A | .30 | .27 | .23 | .29 | .35 | .32 | O | X | X | X | O | O |
| 5600 A | .27 | .20 | .23 | .32 | .37 | .33 | X | X | X | O | O | O |
| 5700 A | .28 | .20 | .26 | .35 | .37 | .26 | X | X | X | O | O | X |
| 5800 A | .23 | .26 | .36 | .41 | .33 | .27 | X | X | O | O | O | X |
| 5900 A | .23 | .29 | .35 | .35 | .28 | .23 | X | X | O | O | X | X |
| 6000 A | .24 | .32 | .34 | .32 | .31 | .22 | X | O | O | O | O | X |
| 6100 A | .25 | .35 | .37 | .29 | .24 | .27 | X | O | O | X | X | X |
| 6200 A | .29 | .34 | .40 | .31 | .25 | .32 | X | O | O | O | X | O |
| 6300 A | .27 | .35 | .38 | .24 | .24 | .31 | X | O | O | X | X | O |
| 6400 A | .30 | .35 | .33 | .26 | .26 | .32 | O | O | O | X | X | O |
| 6500 A | .36 | .38 | .27 | .26 | .32 | .36 | O | O | X | X | O | O |
| 6600 A | .36 | .36 | .23 | .26 | .36 | .38 | O | O | X | X | O | O |
| 6700 A | .38 | .30 | .26 | .27 | .38 | .35 | O | O | X | X | O | O |
| 6800 A | .35 | .34 | .23 | .32 | .36 | .33 | O | O | X | O | O | O |
| 6900 A | .40 | .26 | .28 | .29 | .35 | .31 | O | X | X | X | O | O |
| 7000 A | .36 | .26 | .29 | .31 | .35 | .25 | O | X | X | O | O | X |
| 7100 A | .33 | .24 | .26 | .36 | .36 | .23 | O | X | X | O | O | X |
| 7200 A | .27 | .24 | .35 | .37 | .34 | .29 | X | X | O | O | O | X |
| 7300 A | .24 | .24 | .33 | .35 | .29 | .30 | X | X | O | O | X | O |
| 7400 A | .25 | .23 | .34 | .34 | .28 | .32 | X | X | O | O | X | O |
| 7500 A | .26 | .28 | .39 | .30 | .27 | .32 | X | X | O | O | X | O |
| 7600 A | .20 | .31 | .40 | .28 | .29 | .30 | X | O | O | X | X | O |
| 7700 A | .24 | .38 | .35 | .26 | .26 | .31 | X | O | O | X | X | O |
| 7800 A | .24 | .38 | .33 | .28 | .30 | .36 | X | O | O | X | O | O |
| 7900 A | .28 | .35 | .31 | .29 | .32 | .33 | X | O | O | X | O | O |
| 8000 A | .29 | .35 | .26 | .28 | .33 | .30 | X | O | X | X | O | O |
| 8100 A | .31 | .37 | .24 | .28 | .36 | .32 | O | O | X | X | O | O |
| 8200 A | .36 | .38 | .24 | .32 | .36 | .27 | O | O | X | O | O | X |
| 8300 A | .36 | .33 | .22 | .32 | .39 | .28 | O | O | X | O | O | X |
| 8400 A | .38 | .26 | .30 | .37 | .37 | .24 | O | X | O | O | O | X |
| 8500 A | .38 | .29 | .26 | .38 | .28 | .24 | O | X | X | O | X | X |
| 8600 A | .36 | .27 | .28 | .38 | .31 | .31 | O | X | X | O | O | O |
| 8700 A | .34 | .21 | .34 | .33 | .23 | .27 | O | X | O | O | X | X |
| 8800 A | .29 | .25 | .39 | .33 | .28 | .34 | X | X | O | O | X | O |
| 8900 A | .31 | .30 | .32 | .33 | .27 | .30 | O | O | O | O | X | O |
| 9000 A | .23 | .26 | .37 | .29 | .32 | .32 | X | X | O | X | O | O |
| 9100 A | .23 | .30 | .34 | .29 | .33 | .38 | X | O | O | X | O | O |
| 9200 A | .26 | .37 | .34 | .29 | .29 | .36 | X | O | O | X | X | O |
| 9300 A | .22 | .39 | .34 | .28 | .34 | .33 | X | O | O | X | O | O |
| 9400 A | .28 | .39 | .33 | .30 | .37 | .33 | X | O | O | O | O | O |
| 9500 A | .30 | .36 | .25 | .27 | .34 | .30 | O | O | X | X | O | O |
| 9600 A | .28 | .38 | .28 | .31 | .36 | .27 | X | O | X | O | O | X |
| 9700 A | .31 | .33 | .25 | .34 | .32 | .26 | O | O | X | O | O | X |
| 9800 A | .34 | .31 | .28 | .37 | .31 | .28 | O | O | X | O | O | X |

TABLE 3-continued

| Surface layer thickness | Red Reproduction | | | | | | Ghost Appearance | | | | | |
|---|---|---|---|---|---|---|---|---|---|---|---|---|
| | $n_1$ | $n_2$ | $n_3$ | $n_4$ | $n_5$ | $n_6$ | $n_1$ | $n_2$ | $n_3$ | $n_4$ | $n_5$ | $n_6$ |
| 9900 A | .39 | .27 | .26 | .33 | .26 | .31 | O | X | X | O | X | O |
| 10000 A | .34 | .24 | .27 | .37 | .25 | .29 | O | X | X | O | X | X |

(when the refractive index of the photoconductive layer is 3.2)
note: $n_1$ to $n_6$ respectively means the refractive index of the surface layer. $n_1$ = 1.8, $n_2$ = 1.9, $n_3$ = 2.0, $n_4$ = 2.1, $n_5$ = 2.2, $n_6$ = 2.3

TABLE 4

| Surface layer thickness | Red Reproduction | | | | | | Ghost Appearance | | | | | |
|---|---|---|---|---|---|---|---|---|---|---|---|---|
| | $n_1$ | $n_2$ | $n_3$ | $n_4$ | $n_5$ | $n_6$ | $n_1$ | $n_2$ | $n_3$ | $n_4$ | $n_5$ | $n_6$ |
| 4000 A | .25 | .14 | .20 | .24 | .40 | .39 | X | X | X | X | O | O |
| 4100 A | .22 | .13 | .23 | .31 | .43 | .45 | X | X | X | O | O | O |
| 4200 A | .15 | .20 | .26 | .38 | .45 | .40 | X | X | X | O | O | O |
| 4300 A | .14 | .19 | .36 | .43 | .43 | .35 | X | X | O | O | O | O |
| 4400 A | .17 | .24 | .36 | .42 | .41 | .27 | X | X | O | O | O | X |
| 4500 A | .19 | .30 | .40 | .43 | .37 | .28 | X | O | O | O | O | X |
| 4600 A | .27 | .39 | .39 | .41 | .32 | .19 | X | O | O | O | O | X |
| 4700 A | .29 | .37 | .43 | .33 | .26 | .20 | X | O | O | O | X | X |
| 4800 A | .36 | .47 | .41 | .40 | .20 | .22 | O | O | O | O | X | X |
| 4900 A | .40 | .45 | .34 | .26 | .22 | .23 | O | O | O | X | X | X |
| 5000 A | .41 | .41 | .33 | .25 | .24 | .33 | O | O | O | X | X | O |
| 5100 A | .47 | .36 | .29 | .18 | .23 | .35 | O | O | X | X | X | O |
| 5200 A | .46 | .34 | .27 | .25 | .33 | .36 | O | O | X | X | O | O |
| 5300 A | .41 | .30 | .18 | .27 | .31 | .38 | O | O | X | X | O | O |
| 5400 A | .41 | .28 | .18 | .32 | .39 | .40 | O | X | X | O | O | O |
| 5500 A | .35 | .23 | .25 | .31 | .41 | .32 | O | X | X | O | O | O |
| 5600 A | .28 | .24 | .23 | .34 | .38 | .35 | X | X | X | O | O | O |
| 5700 A | .27 | .22 | .30 | .36 | .41 | .30 | X | X | O | O | O | O |
| 5800 A | .21 | .22 | .33 | .41 | .36 | .27 | X | X | O | O | O | X |
| 5900 A | .22 | .25 | .34 | .38 | .30 | .26 | X | X | O | O | O | X |
| 6000 A | .23 | .30 | .41 | .39 | .26 | .26 | X | O | O | O | X | X |
| 6100 A | .19 | .34 | .39 | .35 | .23 | .26 | X | O | O | O | X | X |
| 6200 A | .24 | .33 | .38 | .32 | .22 | .27 | X | O | O | O | X | X |
| 6300 A | .29 | .41 | .38 | .26 | .28 | .31 | X | O | O | X | X | O |
| 6400 A | .34 | .43 | .32 | .22 | .26 | .38 | O | O | O | X | X | O |
| 6500 A | .35 | .44 | .28 | .20 | .28 | .38 | O | O | X | X | X | O |
| 6600 A | .39 | .36 | .22 | .20 | .31 | .41 | O | O | X | X | O | O |
| 6700 A | .43 | .37 | .22 | .29 | .38 | .38 | O | O | X | X | O | O |
| 6800 A | .39 | .32 | .23 | .26 | .41 | .35 | O | O | X | X | O | O |
| 6900 A | .40 | .25 | .21 | .34 | .36 | .32 | O | X | X | O | O | O |
| 7000 A | .39 | .24 | .29 | .35 | .39 | .30 | O | X | X | O | O | O |
| 7100 A | .33 | .20 | .28 | .37 | .32 | .23 | O | X | X | O | O | X |
| 7200 A | .31 | .26 | .34 | .38 | .27 | .22 | O | X | O | O | X | X |
| 7300 A | .26 | .26 | .37 | .36 | .25 | .23 | X | X | O | O | X | X |
| 7400 A | .23 | .28 | .35 | .35 | .25 | .27 | X | X | O | O | X | X |
| 7500 A | .19 | .26 | .41 | .29 | .27 | .33 | X | X | O | X | X | O |
| 7600 A | .19 | .29 | .40 | .29 | .25 | .33 | X | X | O | X | X | O |
| 7700 A | .20 | .32 | .38 | .29 | .24 | .38 | X | O | O | X | X | O |
| 7800 A | .28 | .40 | .30 | .23 | .31 | .33 | X | O | O | X | O | O |
| 7900 A | .28 | .43 | .30 | .24 | .30 | .39 | X | O | O | X | O | O |
| 8000 A | .30 | .38 | .29 | .23 | .38 | .31 | O | O | X | X | O | O |
| 8100 A | .37 | .34 | .26 | .31 | .39 | .31 | O | O | X | O | O | O |
| 8200 A | .39 | .38 | .23 | .31 | .36 | .26 | O | O | X | O | O | X |
| 8300 A | .42 | .32 | .26 | .31 | .34 | .31 | O | O | X | O | O | O |
| 8400 A | .40 | .25 | .26 | .34 | .34 | .29 | O | X | X | O | O | X |
| 8500 A | .42 | .26 | .30 | .34 | .30 | .27 | O | X | O | O | O | X |

TABLE 4-continued

| Surface layer thickness | Red Reproduction $n_1$ | $n_2$ | $n_3$ | $n_4$ | $n_5$ | $n_6$ | Ghost Appearance $n_1$ | $n_2$ | $n_3$ | $n_4$ | $n_5$ | $n_6$ |
|---|---|---|---|---|---|---|---|---|---|---|---|---|
| 8600 A | .35 | .25 | .34 | .39 | .30 | .31 | O | X | O | O | O | O |
| 8700 A | .33 | .20 | .31 | .40 | .28 | .29 | O | X | O | O | X | X |
| 8800 A | .27 | .27 | .34 | .35 | .27 | .31 | X | X | O | O | X | O |
| 8900 A | .27 | .30 | .35 | .32 | .24 | .31 | X | O | O | O | X | O |
| 9000 A | .28 | .32 | .42 | .27 | .30 | .35 | X | O | O | X | O | O |
| 9100 A | .23 | .36 | .36 | .25 | .33 | .37 | X | O | O | X | O | O |
| 9200 A | .19 | .37 | .34 | .23 | .28 | .31 | X | O | O | X | X | O |
| 9300 A | .23 | .41 | .34 | .28 | .37 | .30 | X | O | O | X | O | O |
| 9400 A | .29 | .37 | .27 | .29 | .35 | .35 | X | O | X | X | O | O |
| 9500 A | .31 | .34 | .28 | .33 | .33 | .32 | O | O | X | O | O | O |
| 9600 A | .32 | .37 | .25 | .31 | .36 | .31 | O | O | X | O | O | O |
| 9700 A | .33 | .35 | .24 | .33 | .31 | .30 | O | O | X | O | O | O |
| 9800 A | .37 | .31 | .26 | .37 | .28 | .30 | O | O | X | O | X | O |
| 9900 A | .36 | .30 | .31 | .33 | .32 | .33 | O | O | O | O | O | O |
| 10000 A | .39 | .28 | .26 | .32 | .26 | .33 | O | X | X | O | X | O |

(when the refractive index of the photoconductive layer is 3.5)
note: $n_1$ to $n_6$ respectively means the refractive index of the surface layer. $n_1$ = 1.8, $n_2$ = 1.9, $n_3$ = 2.0, $n_4$ = 2.1, $n_5$ = 2.2, $n_6$ = 2.3

TABLE 5

| Surface layer: Layer thickness (A) | Surface layer: Refractive index (n) | Cleaning roller | Evaluation on uneven image density caused by uneven sensitivity |
|---|---|---|---|
| 3,500 | 1.9 | magnetic roller | Δ |
| 4,000 | 1.8 | magnetic roller | ○ |
| 4,000 | 1.9 | magnetic roller | ◎ |
| 4,000 | 2.0 | magnetic roller | ◎ |
| 4,000 | 2.3 | magnetic roller | ◎ |
| 10,000 | 1.9 | magnetic roller | ◎ |
| 4,000 | 1.9 | elastic gum | x |
| 5,000 | 1.9 | elastic gum | Δ |

◎: excellent
○: good
Δ: acceptable
x: poor

TABLE 6

| Wavelength region | Additional pair of filters | Lighting voltage | Red reproduction (optical density) | Evaluation on ghost appearance | Total evaluation |
|---|---|---|---|---|---|
| 400 ~ 600 nm | 2 pairs | 72 V x | 0.34 ○ | ○ | Δ |
| 400 ~ 700 nm | 1 pair | 65 V ○ | 0.30 ○ | ○ | ○ |
| 400 ~ 800 nm | no | 58 V ○ | 0.21 x | x | x |

Lighting voltage:
○: permissible range
x: beyond permissible range
Red reproduction:
○: good
x: poor
Ghost:
○: permissible
x: not permissible
Total evaluation:
○: good
Δ: not good
x: poor

TABLE 7

| Surface layer thickness | Red Reproduction $n_1$ | $n_2$ | $n_3$ | $n_4$ | $n_5$ | $n_6$ | Ghost Appearance $n_1$ | $n_2$ | $n_3$ | $n_4$ | $n_5$ | $n_6$ |
|---|---|---|---|---|---|---|---|---|---|---|---|---|
| 4000 A | .23 | .14 | .16 | .30 | .36 | .40 | X | X | X | O | O | O |
| 4100 A | .20 | .14 | .24 | .34 | .43 | .39 | X | X | X | O | O | O |
| 4200 A | .19 | .21 | .24 | .33 | .41 | .39 | X | X | X | O | O | O |
| 4300 A | .13 | .21 | .29 | .39 | .41 | .34 | X | X | X | O | O | O |
| 4400 A | .21 | .29 | .37 | .38 | .39 | .29 | X | X | O | O | O | X |
| 4500 A | .22 | .34 | .42 | .39 | .30 | .28 | X | O | O | O | O | X |
| 4600 A | .23 | .37 | .44 | .42 | .28 | .22 | X | O | O | O | X | X |
| 4700 A | .33 | .41 | .43 | .35 | .22 | .24 | O | O | O | O | X | X |
| 4800 A | .36 | .39 | .39 | .32 | .23 | .23 | O | O | O | O | X | X |
| 4900 A | .35 | .41 | .33 | .26 | .26 | .31 | O | O | O | X | X | O |
| 5000 A | .37 | .44 | .32 | .23 | .23 | .35 | O | O | O | X | X | O |

TABLE 7-continued

| Surface layer thickness | Red Reproduction $n_1$ | $n_2$ | $n_3$ | $n_4$ | $n_5$ | $n_6$ | Ghost Appearance $n_1$ | $n_2$ | $n_3$ | $n_4$ | $n_5$ | $n_6$ |
|---|---|---|---|---|---|---|---|---|---|---|---|---|
| 5100 A | .42 | .36 | .24 | .26 | .23 | .34 | O | O | X | X | X | O |
| 5200 A | .41 | .32 | .27 | .23 | .30 | .40 | O | O | X | X | O | O |
| 5300 A | .37 | .32 | .24 | .28 | .31 | .34 | O | O | X | X | O | O |
| 5400 A | .39 | .29 | .23 | .30 | .38 | .41 | O | X | X | O | O | O |
| 5500 A | .37 | .21 | .22 | .31 | .38 | .35 | O | X | X | O | O | O |
| 5600 A | .32 | .21 | .29 | .33 | .37 | .32 | O | X | X | O | O | O |
| 5700 A | .26 | .20 | .27 | .35 | .37 | .31 | X | X | X | O | O | O |
| 5800 A | .19 | .24 | .33 | .42 | .35 | .26 | X | X | O | O | O | X |
| 5900 A | .25 | .27 | .39 | .35 | .28 | .27 | X | X | O | O | X | X |
| 6000 A | .19 | .26 | .36 | .32 | .26 | .22 | X | X | O | O | X | X |
| 6100 A | .25 | .36 | .37 | .30 | .24 | .30 | X | O | O | O | X | O |
| 6200 A | .26 | .33 | .39 | .28 | .24 | .30 | X | O | O | X | X | O |
| 6300 A | .25 | .39 | .39 | .27 | .29 | .33 | X | O | O | X | X | O |
| 6400 A | .29 | .43 | .32 | .22 | .28 | .33 | X | O | O | X | X | O |
| 6500 A | .35 | .38 | .33 | .21 | .28 | .35 | O | O | O | X | X | O |
| 6600 A | .38 | .34 | .28 | .26 | .35 | .34 | O | O | X | X | O | O |
| 6700 A | .38 | .33 | .22 | .23 | .39 | .34 | O | O | X | X | O | O |
| 6800 A | .36 | .35 | .23 | .27 | .40 | .29 | O | O | X | X | O | X |
| 6900 A | .35 | .24 | .23 | .31 | .34 | .32 | O | X | X | O | O | O |
| 7000 A | .36 | .24 | .26 | .38 | .39 | .29 | O | X | X | O | O | X |
| 7100 A | .31 | .25 | .32 | .35 | .36 | .26 | O | X | O | O | O | X |
| 7200 A | .30 | .24 | .34 | .39 | .30 | .29 | O | X | O | O | O | X |
| 7300 A | .28 | .24 | .37 | .38 | .29 | .31 | X | X | O | O | X | O |
| 7400 A | .29 | .29 | .35 | .35 | .26 | .26 | X | X | O | O | X | X |
| 7500 A | .23 | .30 | .40 | .31 | .27 | .34 | X | O | O | O | X | O |
| 7600 A | .25 | .35 | .39 | .31 | .22 | .37 | X | O | O | O | X | O |
| 7700 A | .25 | .34 | .32 | .28 | .28 | .36 | X | O | O | X | X | O |
| 7800 A | .28 | .34 | .37 | .28 | .33 | .36 | X | O | O | X | O | O |
| 7900 A | .26 | .37 | .35 | .23 | .32 | .34 | X | O | O | X | O | O |
| 8000 A | .32 | .40 | .28 | .26 | .37 | .32 | O | O | X | X | O | O |
| 8100 A | .32 | .40 | .23 | .29 | .37 | .27 | O | O | X | X | O | X |
| 8200 A | .32 | .36 | .27 | .29 | .35 | .31 | O | O | X | X | O | O |
| 8300 A | .39 | .29 | .27 | .35 | .37 | .24 | O | X | X | O | O | X |
| 8400 A | .34 | .31 | .27 | .33 | .31 | .23 | O | O | X | O | O | X |
| 8500 A | .36 | .30 | .32 | .35 | .29 | .29 | O | O | O | O | X | X |
| 8600 A | .34 | .27 | .33 | .35 | .27 | .26 | O | X | O | O | X | X |
| 8700 A | .29 | .22 | .37 | .33 | .30 | .27 | X | X | O | O | O | X |
| 8800 A | .29 | .26 | .33 | .36 | .24 | .36 | X | X | O | O | X | O |
| 8900 A | .26 | .25 | .33 | .28 | .28 | .35 | X | X | O | X | X | O |
| 9000 A | .28 | .31 | .39 | .30 | .29 | .31 | X | O | O | O | X | O |
| 9100 A | .25 | .30 | .34 | .29 | .27 | .36 | X | O | O | X | X | O |
| 9200 A | .25 | .34 | .35 | .25 | .33 | .31 | X | O | O | X | O | O |
| 9300 A | .23 | .36 | .35 | .29 | .34 | .34 | X | O | O | X | O | O |
| 9400 A | .26 | .34 | .30 | .26 | .35 | .31 | X | O | O | X | O | O |
| 9500 A | .29 | .35 | .27 | .28 | .34 | .29 | X | O | X | X | O | X |
| 9600 A | .31 | .34 | .23 | .30 | .32 | .30 | O | O | X | O | O | O |
| 9700 A | .35 | .34 | .28 | .35 | .36 | .28 | O | O | X | O | O | X |
| 9800 A | .39 | .30 | .26 | .34 | .33 | .28 | O | O | X | O | O | X |
| 9900 A | .37 | .33 | .25 | .36 | .28 | .30 | O | O | X | O | X | O |

(when the refractive index of the photoconductive layer is 3.2)
note: $n_1$ to $n_6$ respectively means the refractive index of the surface layer. $n_1$ = 1.8, $n_2$ = 1.9, $n_3$ = 2.0, $n_4$ = 2.1, $n_5$ = 2.2, $n_6$ = 2.3

TABLE 8

| Surface layer thickness | Red Reproduction | | | | | | Ghost Appearance | | | | | |
|---|---|---|---|---|---|---|---|---|---|---|---|---|
| | $n_1$ | $n_2$ | $n_3$ | $n_4$ | $n_5$ | $n_6$ | $n_1$ | $n_2$ | $n_3$ | $n_4$ | $n_5$ | $n_6$ |
| 4000 A | .23 | .13 | .15 | .29 | .37 | .42 | X | X | X | X | O | O |
| 4100 A | .19 | .12 | .23 | .34 | .45 | .41 | X | X | X | O | O | O |
| 4200 A | .17 | .20 | .23 | .34 | .43 | .40 | X | X | X | O | O | O |
| 4300 A | .12 | .20 | .29 | .41 | .44 | .35 | X | X | X | O | O | O |
| 4400 A | .20 | .29 | .38 | .40 | .40 | .28 | X | X | O | O | O | X |
| 4500 A | .21 | .35 | .44 | .41 | .31 | .26 | X | O | O | O | O | X |
| 4600 A | .22 | .37 | .45 | .44 | .28 | .20 | X | O | O | O | X | X |
| 4700 A | .33 | .42 | .45 | .36 | .21 | .23 | O | O | O | O | X | X |
| 4800 A | .37 | .41 | .40 | .32 | .21 | .22 | O | O | O | O | X | X |
| 4900 A | .36 | .43 | .34 | .25 | .24 | .31 | O | O | O | X | X | O |
| 5000 A | .38 | .46 | .32 | .22 | .21 | .35 | O | O | O | X | X | O |
| 5100 A | .43 | .38 | .24 | .24 | .23 | .35 | O | O | X | X | X | O |
| 5200 A | .43 | .33 | .26 | .22 | .30 | .42 | O | O | X | X | O | O |
| 5300 A | .38 | .32 | .23 | .27 | .31 | .35 | O | O | X | X | O | O |
| 5400 A | .40 | .28 | .22 | .30 | .40 | .42 | O | X | X | O | O | O |
| 5500 A | .38 | .20 | .21 | .31 | .40 | .36 | O | X | X | O | O | O |
| 5600 A | .33 | .20 | .28 | .34 | .39 | .32 | O | X | X | O | O | O |
| 5700 A | .25 | .19 | .27 | .36 | .38 | .30 | X | X | X | O | O | O |
| 5800 A | .19 | .23 | .33 | .44 | .36 | .25 | X | X | O | O | O | X |
| 5900 A | .24 | .27 | .40 | .37 | .28 | .25 | X | X | O | O | X | X |
| 6000 A | .18 | .26 | .38 | .33 | .26 | .20 | X | X | O | O | X | X |
| 6100 A | .24 | .37 | .38 | .31 | .22 | .29 | X | O | O | O | X | X |
| 6200 A | .26 | .34 | .41 | .28 | .22 | .30 | X | O | O | X | X | O |
| 6300 A | .25 | .40 | .40 | .26 | .28 | .34 | X | O | O | X | X | O |
| 6400 A | .29 | .44 | .33 | .21 | .27 | .34 | X | O | O | X | X | O |
| 6500 A | .35 | .40 | .33 | .20 | .28 | .37 | O | O | O | X | X | O |
| 6600 A | .39 | .35 | .27 | .25 | .36 | .36 | O | O | X | X | O | O |
| 6700 A | .40 | .34 | .21 | .23 | .40 | .36 | O | O | X | X | O | O |
| 6800 A | .37 | .35 | .22 | .27 | .41 | .30 | O | O | X | X | O | O |
| 6900 A | .37 | .24 | .22 | .31 | .35 | .32 | O | X | X | O | O | O |
| 7000 A | .37 | .23 | .25 | .39 | .40 | .28 | O | X | X | O | O | X |
| 7100 A | .32 | .24 | .32 | .36 | .37 | .24 | O | X | O | O | O | X |

TABLE 8-continued

| Surface layer thickness | Red Reproduction | | | | | | Ghost Appearance | | | | | |
|---|---|---|---|---|---|---|---|---|---|---|---|---|
| | $n_1$ | $n_2$ | $n_3$ | $n_4$ | $n_5$ | $n_6$ | $n_1$ | $n_2$ | $n_3$ | $n_4$ | $n_5$ | $n_6$ |
| 7200 A | .30 | .23 | .34 | .41 | .30 | .28 | O | X | O | O | O | X |
| 7300 A | .28 | .23 | .38 | .39 | .29 | .30 | X | X | O | O | X | O |
| 7400 A | .28 | .29 | .36 | .35 | .25 | .25 | X | X | O | O | X | X |
| 7500 A | .22 | .30 | .42 | .31 | .26 | .34 | X | O | O | O | X | O |
| 7600 A | .24 | .35 | .40 | .30 | .21 | .38 | X | O | O | O | X | O |
| 7700 A | .24 | .35 | .34 | .27 | .27 | .38 | X | O | O | X | X | O |
| 7800 A | .27 | .36 | .38 | .27 | .33 | .38 | X | O | O | X | O | O |
| 7900 A | .26 | .39 | .35 | .22 | .33 | .35 | X | O | O | X | O | O |
| 8000 A | .32 | .42 | .27 | .25 | .38 | .33 | O | O | X | X | O | O |
| 8100 A | .33 | .41 | .22 | .29 | .38 | .28 | O | O | X | X | O | X |
| 8200 A | .33 | .37 | .25 | .30 | .37 | .30 | O | O | X | O | O | O |
| 8300 A | .40 | .29 | .26 | .36 | .39 | .23 | O | X | X | O | O | X |
| 8400 A | .36 | .30 | .26 | .34 | .31 | .22 | O | O | X | O | O | X |
| 8500 A | .37 | .29 | .31 | .37 | .29 | .28 | O | X | O | O | X | X |
| 8600 A | .34 | .26 | .33 | .37 | .26 | .25 | O | X | O | O | X | X |
| 8700 A | .29 | .21 | .38 | .34 | .29 | .27 | X | X | O | O | X | X |
| 8800 A | .29 | .25 | .34 | .36 | .23 | .36 | X | X | O | O | X | O |
| 8900 A | .25 | .24 | .35 | .29 | .27 | .36 | X | X | O | X | X | O |
| 9000 A | .27 | .31 | .40 | .29 | .29 | .32 | X | O | O | X | X | O |
| 9100 A | .24 | .30 | .35 | .28 | .27 | .38 | X | O | O | X | X | O |
| 9200 A | .24 | .35 | .35 | .24 | .34 | .32 | X | O | O | X | O | O |
| 9300 A | .22 | .37 | .35 | .28 | .35 | .35 | X | O | O | X | O | O |
| 9400 A | .25 | .35 | .29 | .25 | .36 | .31 | X | O | X | X | O | O |
| 9500 A | .29 | .36 | .26 | .28 | .35 | .29 | X | O | X | X | O | X |
| 9600 A | .31 | .35 | .22 | .30 | .33 | .29 | O | O | X | O | O | X |
| 9700 A | .36 | .35 | .27 | .35 | .37 | .27 | O | O | X | O | O | X |
| 9800 A | .40 | .30 | .26 | .35 | .33 | .27 | O | O | X | O | O | X |
| 9900 A | .39 | .33 | .25 | .37 | .28 | .29 | O | O | X | O | X | X |
| 10000 A | .38 | .30 | .26 | .34 | .29 | .31 | O | O | X | O | X | O |

(when the refractive index of the photoconductive layer is 3.5)
note: $n_1$ to $n_6$ respectively means the refractive index of the surface layer. $n_1$ = 1.8, $n_2$ = 1.9, $n_3$ = 2.0, $n_4$ = 2.1, $n_5$ = 2.2, $n_6$ = 2.3

TABLE 9

| | |
|---|---|
| Substrate | JIS5000 series aluminum cylinder<br>outer diameter: 108 mm, length: 360 mm, thickness: 5 mm |
| Charge injection inhibition layer | A-Si:B:H (Si: 85 atomic %, B: 3000 ppm, H: 15 atomic %)<br>layer thickness: 2 μm |
| Photoconductive layer | A-Si:H (Si: 85 atomic %, H: 15 atomic %)<br>refractive index (n) = 3.2, layer thickness: 25 μm |
| Surface layer | A-Si:C:H (Si: 25 atomic %, C: 40 atomic % H: 35 atomic %)<br>refractive index (n) = 2.0, layer thickness (d) = 4800A |

TABLE 10

| | |
|---|---|
| Substrate | JIS5000 series aluminum cylinder<br>outer diameter: 108 mm, length: 360 mm, thickness: 5 mm |
| Charge injection inhibition layer | A-Si:B:H (Si: 85 atomic %, B: 3000 ppm, H: 15 atomic %)<br>layer thickness: 2 μm |
| Photoconductive layer | A-Si:H (Si: 85 atomic %, H: 15 atomic %)<br>refractive index (n) = 3.2, layer thickness: 25 μm |
| Surface layer | A-Si:C:H (Si: 25 atomic %, C: 40 atomic % H: 35 atomic %)<br>refractive index (n) = 2.0, layer thickness (d) = 500A |

TABLE 11

| | |
|---|---|
| Substrate | JIS5000 series aluminum cylinder<br>outer diameter: 108 mm, length: 360 mm, thickness: 5 mm |
| Charge injection inhibition layer | A-Si:B:H (Si: 85 atomic %, B: 3000 ppm, H: 15 atomic %)<br>layer thickness: 2 μm |
| Photoconductive layer | A-Si:H (Si: 85 atomic %, H: 15 atomic %)<br>refractive index (n) = 3.2, layer thickness: 25 μm |
| Surface layer | A-Si:C:H (Si: 25 atomic %, C: 40 atomic % H: 35 atomic %)<br>refractive index (n) = 2.0, layer thickness (d) = 4800A |

TABLE 12

| | |
|---|---|
| Substrate | JIS5000 series aluminum cylinder<br>outer diameter: 108 mm, length: 360 mm, thickness: 5 mm |
| Charge injection inhibition layer | A-Si:B:H (Si: 85 atomic %, B: 3000 ppm, H: 15 atomic %)<br>layer thickness: 2 μm |
| Photoconductive layer | A-Si:H (Si: 85 atomic %, H: 15 atomic %)<br>refractive index (n) = 3.2, layer thickness: 25 μm |
| Surface | A-Si:C:H (Si: 25 atomic %, C: 40 atomic % H: 35 atomic %) |

TABLE 12-continued

| layer | refractive index (n) = 2.0, layer thickness (d) = 500A |
|---|---|

What is claimed is:

1. A red reproduction-improving electrophotographic image-forming method carried out in an electrophotographic image-forming system, comprising a halogen lamp light source, an optical system, a cylindrical photosensitive member, a main corona charger, an electrostatic latent image-forming mechanism, a development mechanism containing a magnetic toner, a transfer sheet feeding mechanism, a transfer charger, a separating charger, a transfer sheet conveying mechanism, a cleaning mechanism and a charge-removing light source which is capable of adjusting an image-forming process speed, the improvement comprising:

(a) irradiating an image-forming light of a continuous wavelength in the region of from 400 to 700 nm from said halogen lamp light source for forming an electrostatic latent image on said photosensitive member, (b) cleaning the surface of said photosensitive member by a magnet roller capable of forming a toner brush comprising magnetic materials of said magnetic toner in said cleaning mechanism, and (c) employing an amorphous silicon system photosensitive member in a cylindrical form as said cylindrical photosensitive member; said amorphous silicon system photosensitive member comprising a substrate and a light receiving layer which comprises a 0.01 to 10 μm thick charge injection inhibition layer composed of an amorphous material containing silicon atoms as the matrix, a 1 to 100 μm thick photoconductive layer having a refractive index of 1.9 to 2.3 of 3.2 to 3.5 composed of an amorphous material containing silicon atoms as the matrix and at least hydrogen atoms, and a 4000 to 10000 Å t hick surface layer having a refractive index composed of an A-SiC:H material, said surface layer has a thickness D in one of the following five ranges (i) to (v): (i) range of $D_1$–$D_2$, (ii) range of $D_3$–$D_4$, (iii) range of $D_5$–$D_6$, (iv) range of $D_7$–$D_8$ and (v) range of $D_9$–$D_{10}$, wherein the value of each D is obtained by the following linear equation (I) for the refractive index-depending linear line of a critical red reproduction thickness of the surface layer:

$$D_K = A_K \times n + B_K \quad (I)$$

wherein 4000 Å $\leqq D_K \leqq$ 10000 Å, K is an integer of 1 to 10, n is the refractive index for the surface layer, $A_K = -a_K \times 0.462 - 60$, wherein $A_K$ is a slope of said linear equation $D_K$, $B_K 1.924 \times a_K + 120$, wherein $B_K$ is an intercept of said linear equation $D_K$, and

| | |
|---|---|
| $a_1$ = 4300 | $a_2$ = 5100 |
| $a_3$ = 5700 | $a_4$ = 6500 |
| $a_5$ = 7200 | $a_6$ = 8000 |
| $a_7$ = 8600 | $a_8$ = 9400 |
| $a_9$ = 10000 | $a_{10}$ = 10800. |

2. A red reproduction-improving electrophotographic image-forming method according to claim 1, wherein the image-forming process is carried out at an image-forming process speed of 450 mm/sec. or more 3. A red reproduction-improving electrophotographic image-forming method according to claim 1, wherein said development mechanism comprises a plurality of development mechanisms respectively containing respective different magnetic color toners.

4. An electrophotographic image-forming method which comprises:

(a) employing an amorphous silicon system photosensitive member comprising a substrate and a light receiving layer disposed on said substrate; said light receiving layer comprising a 1 to 100 μm thick photoconductive layer having a refractive index of 3.2 to 3.5 composed of an amorphous material containing silicon atoms as the matrix and at least hydrogen atoms and a 0.4 to 1 μm thick surface layer having a refractive index of 1.9 to 2.3 composed of an amorphous material containing silicon atoms, carbon atoms and hydrogen atoms and wherein the refractive index of said surface layer is n and the thickness of said surface layer is D, said D is in one of the following five ranges (i) to (v): (i) range of $D_1$–$D_2$, (ii) range of $D_3$–$D_4$, (iii) range of $D_5$–$D_6$, (iv) range of $D_7$–$D_8$, and (v) range of $D_9$–$D_{10}$, wherein each of $D_1$ to $D_{10}$ is:

$D_1 = -2047 \times n + 8393$
$D_2 = -2416 \times n + 9932$
$D_3 = -2693 \times n + 11087$
$D_4 = -3063 \times n + 12626$
$D_5 = -3386 \times n + 13973$
$D_6 = -3756 \times n + 15512$
$D_7 = -4033 \times n + 16666$
$D_8 = -4403 \times n + 18206$
$D_9 = -4680 \times n + 19360$
$D_{10} = -5050 \times n + 20899$.

(b) subjecting said photosensitive member to charging by a corona charger through the surface of said photosensitive member, (c) reflecting light from a light source capable of generating light having a continuous wavelength of 400 nm to 700 nm at the surface of an original to irradiate the surface of said photosensitive member, thereby forming a latent image on the surface of said photosensitive member, (d) forming a toner image on the surface of said photosensitive member in a development mechanism employing a magnetic toner as the developer corresponding to said latent image, (e) transferring said toner image onto a transfer sheet, and (f) cleaning the surface of said photosensitive member by a magnet roller.

5. An electrophotographic image-forming method according to claim 4, wherein the step of transferring the toner image to the transfer sheet is carried out at a speed of 450 mm/sec.

6. An electrophotographic image-forming method according to claim 4, including employing at least two development devices in the development mechanism.

7. An electrophotographic image-forming method according to claim 4, including employing a plurality of development devices corresponding to the number of magnetic color toners to be used for forming a colored toner image as the development mechanism.

* * * * *

UNITED STATES PATENT AND TRADEMARK OFFICE

CERTIFICATE OF CORRECTION

PATENT NO. : 5,112,709

DATED : May 12, 1992

INVENTOR(S) : KOJI YAMAZAKI, ET AL.

It is certified that error appears in the above-identified patent and that said Letters Patent is hereby corrected as shown below:

COLUMN 2

Line 28, "arrived" should read --it arrives--.
Line 43, "a" (second occurrence) should read --an--.
Line 50, "wave length" should read --wavelength--.
Line 65, "a" (first occurrence) should read --an--.

COLUMN 3

Line 26, "original." should read --original).--.
Line 32, "what" should read --that--.
Line 48, "charge." should read --charger.--.

COLUMN 4

Line 48, "intercept" should read --integer--.
Line 51, "integer" should read --intercept--.

COLUMN 5

Line 33, "were" should read --was--.

COLUMN 6

Line 18, "one" should read --and one--.

COLUMN 9

Line 26, "to" should read --from--.
Line 54, "other part" should read --a part other--.
Line 66, "to" should read --from--.

UNITED STATES PATENT AND TRADEMARK OFFICE

CERTIFICATE OF CORRECTION

PATENT NO. : 5,112,709

DATED : May 12, 1992

INVENTOR(S) : KOJI YAMAZAKI, ET AL.

It is certified that error appears in the above-identified patent and that said Letters Patent is hereby corrected as shown below:

COLUMN 10

Line 16, "rollers 220" should read --roller 220--.
Line 19, "lamp 201" should read --lamp 209--.
Line 35, "ling" should read --long--.
Line 46, "corresponds" should read --corresponds to--.
Line 51, "sponds" should read --sponds to--.

COLUMN 13

Line 45, "of" should be deleted.

COLUMN 14

Line 19, "being" should read --was--.
Line 35, "cylinder" should read --cylinder.--.

COLUMN 15

Line 28, "000," should read --8000,--.

COLUMN 17

Line 33, "$4000<D_K\leq 10000$," should read --$4000\leq D_K\leq 10000$,--.
Line 45, "a" (first occurrence) should read --an--.

COLUMN 20

Line 64, "copies" should read --copied--.

UNITED STATES PATENT AND TRADEMARK OFFICE

CERTIFICATE OF CORRECTION

PATENT NO. : 5,112,709

DATED : May 12, 1992

INVENTOR(S) : KOJI YAMAZAKI, ET AL.

It is certified that error appears in the above-identified patent and that said Letters Patent is hereby corrected as shown below:

COLUMN 22

Line 67, "s" should read --as--.

COLUMN 24

Line 51, "$4000<D_K\leq 10000$," should read --$4000\leq D_K\leq 10000$,--.
Line 63, "a" (first occurrence) should read --an--.

COLUMN 26

Line 34, "modified" (first occurrence) should read --modification--.

COLUMN 27

Line 21, "excelling" should read --excellent--.
Line 24, "Example" should read --Example 3--.

COLUMN 28

Line 21, "modified" (first occurrence) should read --modification--.

COLUMN 35

Line 36, "1.9 to 2.3 of" should be deleted.
Line 38, "t" should be deleted.
Line 39, "hick" should read --thick-- and "index" should read --index of 1.9-2.3--.
Line 56, "$B_K$1.924" should read --$B_K$ = 1.924--.

UNITED STATES PATENT AND TRADEMARK OFFICE

CERTIFICATE OF CORRECTION

PATENT NO. : 5,112,709

DATED : May 12, 1992

INVENTOR(S) : KOJI YAMAZAKI, ET AL.

It is certified that error appears in the above-identified patent and that said Letters Patent is hereby corrected as shown below:

COLUMN 35

Line 68, "more" should read --more.--.

Signed and Sealed this

Thirty-first Day of August, 1993

Bruce Lehman

*Attest:*

BRUCE LEHMAN

*Attesting Officer*

*Commissioner of Patents and Trademarks*